US008455167B2

(12) United States Patent
Shiotari et al.

(10) Patent No.: US 8,455,167 B2
(45) Date of Patent: Jun. 4, 2013

(54) TONER, BINARY DEVELOPER, AND IMAGE FORMING METHOD

(75) Inventors: Yoshiaki Shiotari, Mishima (JP); Kosuke Fukudome, Suntou-gun (JP); Nozomu Komatsu, Mishima (JP); Kunihiko Nakamura, Gotemba (JP); Kentaro Kamae, Mishima (JP); Hiroyuki Fujikawa, Yokohama (JP); Koh Ishigami, Mishima (JP); Takayuki Itakura, Mishima (JP); Hironori Minagawa, Moriya (JP)

(73) Assignee: Canon Kabushiki Kaisha, Tokyo (JP)

( * ) Notice: Subject to any disclaimer, the term of this patent is extended or adjusted under 35 U.S.C. 154(b) by 285 days.

(21) Appl. No.: 12/965,677

(22) Filed: Dec. 10, 2010

(65) Prior Publication Data

US 2011/0143277 A1 Jun. 16, 2011

(30) Foreign Application Priority Data

Dec. 14, 2009 (WO) ..... PCT/JP2009/070855

(51) Int. Cl.
*G03G 9/08* (2006.01)

(52) U.S. Cl.
USPC ..... 430/110.1; 430/110.3; 430/108.6; 430/108.7

(58) Field of Classification Search
USPC ..... 430/110.1, 110.3, 108.6, 108.7
See application file for complete search history.

(56) References Cited

U.S. PATENT DOCUMENTS

| | | | | |
|---|---|---|---|---|
| 6,022,661 | A | 2/2000 | Kurose | |
| 6,100,000 | A | 8/2000 | Anno | |
| 2005/0079429 | A1 | 4/2005 | Hayami | |
| 2006/0275680 | A1 * | 12/2006 | Miyakawa | 430/45 |
| 2008/0070145 | A1 * | 3/2008 | Onda et al. | 430/110.4 |
| 2009/0233212 | A1 * | 9/2009 | Fujikawa et al. | 430/109.4 |

FOREIGN PATENT DOCUMENTS

| | | | |
|---|---|---|---|
| JP | 11-295989 | A | 10/1999 |
| JP | 2000-3068 | A | 1/2000 |
| JP | 2000-3075 | A | 1/2000 |
| JP | 2002-72566 | A | 3/2002 |
| JP | 2002-196532 | A | 7/2002 |
| JP | 2005-107517 | A | 4/2005 |
| JP | 2005-316265 | A | 11/2005 |
| JP | 2008-76574 | A | 4/2008 |
| JP | 2008-89919 | A | 4/2008 |

* cited by examiner

*Primary Examiner* — Hoa V Le
(74) *Attorney, Agent, or Firm* — Canon U.S.A., Inc., IP Division

(57) ABSTRACT

It is an object of the present invention to provide a toner having the transfer efficiency and the cleanability in combination, exhibiting excellent stress resistance, and ensuring the low-temperature fixing.

A toner characterized in that the average circularity of the above-described toner is 0.960 or more, and 0.985 or less, where the average circularity is analyzed by dividing particles having a circle equivalent diameter of 1.98 μm or more, and 200.00 μm or less, the number A of toners having a circularity of 0.990 or more, and 1.000 or less is 25.0 percent by the number or less, and the percentage of the number of particles B having a circle equivalent diameter of 0.50 μm or more, and 1.98 μm or less relative to the total particles of 0.50 μm or more, and 200.00 μm or less is 10.0 percent by the number or less.

7 Claims, 4 Drawing Sheets

TONER, BINARY DEVELOPER, AND IMAGE FORMING METHOD

TECHNICAL FIELD

The present invention relates to a toner used for an electrophotographic system, an electrostatic recording system, an electrostatic printing system, and a toner jet system, a binary developer including the toner, and an image forming method by using the toner.

BACKGROUND ART

Regarding an electrophotographic apparatus, in order to obtain good image characteristics over the long term, a toner has been required to have the transferability and the cleanability in combination. Consequently, control of the distribution state of toner particles having a specific shape has been performed previously.

In PTL 1, it is intended to ensure the compatibility between the transferability and the cleanability by specifying the average circularity and the circularity distribution of toner particles having a circle equivalent diameter of 3.00 μm or more among toner particles.

Furthermore, in PTL 2, the transfer efficiency is improved and higher image quality is achieved by controlling the percentage of the number of toner particles having a circularity of 0.950 or less to be 40 percent by the number or less in toner particles having a particle diameter of 2 μm or more, and 5 μm or less and optimizing the shapes of toner particles having small particle diameters.

CITATION LIST

Patent Literature

PTL 1: Japanese Patent Laid-Open No. 2005-107517

PTL 2: Japanese Patent Laid-Open No. 2008-076574

However, the toner described in PTL 1 has a small average circularity and there is room for improvement in transferability and developing property.

Furthermore, as a result of examination performed by the present inventors on the toner of PTL 2, in the case where small particles having a particle diameter of less than 2 μm are large in number and 10,000 sheets or more of printing is performed under the condition that the proportion of printed image is 40%, the surface of a magnetic carrier is spent with the toner and, thereby, the image density may be educed.

It is an object of the present invention to provide a toner having the transfer efficiency and the cleanability in combination and exhibiting excellent stress resistance, wherein changes in image density are at a low level in the case where a plurality of sheets of copying or printing is performed. Furthermore, it is an object of the present invention to provide a binary developer and an image forming method, wherein the above-described toner is used.

SUMMARY OF INVENTION

The present invention relates to a toner characterized by including toner particles containing at least a binder resin and a wax, wherein the above-described toner has a weight average particle diameter (D4) of 3.0 μm or more, and 8.0 μm or less and satisfies the following conditions (a) and (b) measured by using a flow particle image analyzer with an image processing resolution of 512×512 pixels. (a) Regarding particles having a circle equivalent diameter of 1.98 μm or more, and 200.00 μm or less, the average circularity of the above-described toner is 0.960 or more, and 0.985 or less and particles having a circularity of 0.990 or more, and 1.000 or less constitute 25.0 percent by the number or less. (b) Particles having a circle equivalent diameter of 0.50 μm or more, and 1.98 μm or less constitute 10.0 percent by the number or less of particles of 0.50 μm or more, and 200.00 μm or less. Furthermore, the present invention relates to a binary developer and an image forming method, wherein the above-described toner is used.

Further features of the present invention will become apparent from the following description of exemplary embodiments with reference to the attached drawings.

DESCRIPTION OF EMBODIMENTS

Figure 1A:
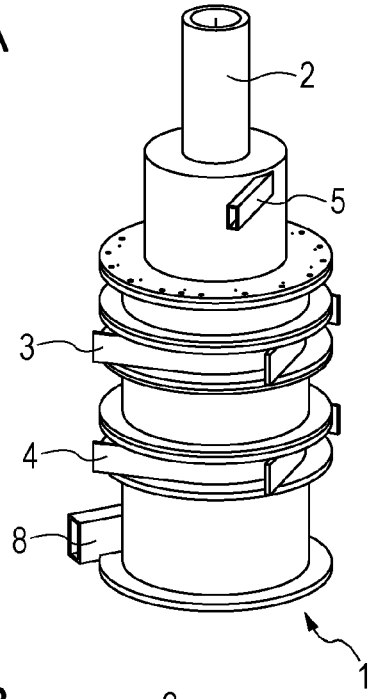
FIGS. 1A to 1C are diagrams showing a heat treatment apparatus favorably used for the present invention.

A toner according to the present invention has a weight average particle diameter (D4) of 3.0 μm or more, and 8.0 μm or less and it is necessary to satisfy the following condition (a) in the measurement with a flow particle image analyzer with an image processing resolution of 512×512 pixels (0.37 μm×0.37 μm per pixel). (a) Regarding particles having a circle equivalent diameter of 1.98 μm or more, and 200.00 μm or less, particles having an average circularity of 0.960 or more, and 0.985 or less and a circularity of 0.990 or more, and 1.000 or less constitute 25.0 percent by the number or less. Further preferably, the average circularity of the toner is 0.960 or more, and 0.975 or less and particles having a circularity of 0.990 or more, and 1.000 or less constitute 20.0 percent by the number or less.

A nearly spherical toner has a small contact area with an image bearing member (photosensitive member) as compared with that of an odd-form toner and, therefore, has a small adhesion to the photosensitive member. Furthermore, regarding an electric field formed in a transfer step, as the toner becomes close to a sphere, the electric field is applied uniformly, and is transferred to a transfer-receiving member easily. For the above-described reason, in general, as the toner becomes close to a sphere, the transfer efficiency is high. On the other hand, as the toner becomes close to a sphere, the contact area between the toner and a cleaning blade becomes small. Consequently, it is difficult to scrape off a transfer residual toner on the image bearing member with a cleaning blade, and the cleanability is degraded. As described above, the transferability and the cleanability are in the relationship of trade-off to some extent, and it is difficult to ensure the compatibility between the transferability and the cleanability. As for the cause of degradation of the cleanability, in particular, the amount of presence of particles having a circularity of 0.990 or more has an influence. However, in general, there is a positive correlation between the amount of presence of particles having a circularity of 0.990 or more and the average circularity, and if reduction of the amount of presence of particles having a circularity of 0.990 or more is intended, the average circularity is reduced and the transferability is degraded. Consequently, in order to ensure the compatibility between the transferability and the cleanability, it is necessary to control the average circularity and the circularity distribution of the toner within an appropriate range.

The present inventors performed intensive research and, as a result, found that the compatibility between the transfer efficiency and the cleanability was able to be ensured in the case where the average circularity was 0.960 or more, and 0.985 or less and, in addition, particles having a circularity of 0.990 or more, and 1.000 or less constitute 25.0 percent by the number or less.

The reasons for this are as described below. In the case where two types of toners, which have different circularity distributions but have the same average circularity, are compared, as the proportion of particles having a circularity of 0.990 or more, and 1.000 or less in the toner increases, the circularity distribution of the toner is broadened. In this toner having a broad circularity distribution, a large number of toners close to a sphere are present in the transfer residual toner as compared with the toner having the same average circularity but having a narrow circularity distribution. The toner close to a sphere slips through a gap of the cleaning blade easily and, therefore, a charge roller is stained, so that a defective image resulting from charge variations on the image bearing member occurs easily.

On the other hand, in the above-described toner having a narrow circularity distribution, the amount of transfer residual toner close to a sphere is reduced as compared with the toner having a broad circularity distribution. As a result, regarding the toner having a narrow circularity distribution, the circularity of most of toners subjected to blade cleaning is lower than that of a sphere. Therefore, scraping with the blade can be performed, so that the cleanability is good. In the case where the proportion of toners having a circularity of 0.990 or more, and 1.000 or less exceeds 25.0 percent by the number, the cleanability is degraded because a large number of toners are close to a sphere.

In the case where the average circularity is less than 0.960, a large number of odd-form toners are present and, thereby, large amounts of transfer residual toner remains on the image bearing member, so that the transfer efficiency is not sufficient. Consequently, in output of an image, the amount of toner required for outputting a sufficient image density to the transfer-receiving member increases. This is not favorable from the viewpoint of running cost as well. Moreover, in the case where the average circularity exceeds 0.985, the transfer efficiency is good. However, a large number of toners are close to a sphere and, therefore, the transfer residual toner slips through a gap of the cleaning blade easily, so that the transfer residual toner remains on the image bearing member. As a result, the transfer residual toner stains the charge roller and, thereby, poor charging of the image bearing member may occur. In addition, in image formation, a defective image may occur because of charge variations on the image bearing member resulting from the transfer residual toner on the image bearing member. In particular, this phenomenon may occur conspicuously in the case where the outermost surface of the image bearing member cannot be scraped with the cleaning blade. It is necessary that the toner according to the present invention satisfies the following condition (b) in the measurement with a flow particle image analyzer with an image processing resolution of 512×512 pixels (0.37 μm×0.37 μm per pixel). (b) The particles having a circle equivalent diameter of 0.50 μm or more, and 1.98 μm or less constitute 10.0 percent by the number or less of particles of 0.50 μm or more, and 200.00 μm or less. Furthermore, 7.0 percent by the number or less is preferable.

If particles of 0.50 μm or more, and 1.98 μm or less constitute 10 percent by the number or less, in the case where the toner according to the present invention is used as a binary developer, toner-spent to the surface of the magnetic carrier can be suppressed. Consequently, degradation in triboelectric charging ability of the magnetic carrier can be suppressed, so that regarding, in particular, long-term endurance of a high coverage rate (proportion of printed image of 40% or more) accompanied by a large amount of consumption of toner, an increase in lifespan of the developer can be facilitated.

On the other hand, if particles of 0.50 μm or more, and 1.98 μm or less exceed 10.0 percent by the number, regarding long-term endurance of a high coverage rate (coverage rate: 40% or more), the surface of the magnetic carrier is spent by the toner of 0.5 μm or more, and 1.98 μm or less because of a stress in a developing apparatus. As a result, the triboelectric charging ability of the magnetic carrier is degraded and, thereby, a reduction in amount of triboelectric charge of the toner occurs, so that a reduction in image density, an occurrence of fogging in a non-image area, and an occurrence of scattering of toner in the developing apparatus may be caused. Hitherto, it has been very difficult to obtain a toner, wherein the average circularity has been 0.960 or more, and 0.985 or less, the proportion of toners having a circularity of 0.990 or more has been reduced to 25 percent by the number or less, and the proportion of toners of 0.5 μm or more, and 1.98 μm or less has been reduced to 10 percent by the number or less. For example, in the case where toner particles are produced by an emulsion aggregation method, a toner may be obtained, wherein the average circularity is 0.960 or more, and 0.985 or less and the proportion of particles having a circularity of 0.990 or more is 25 percent by the number or less. However, in the case where the toner particles are produced by the emulsion aggregation method, the proportion of toners of 0.5 μm or more, and 1.98 μm or less exceeds 10 percent by the number. This is caused by remaining of emulsion particles generated in a production process of the toner. Furthermore, a toner including toner particles obtained by a suspension polymerization method has a very high average circularity, and the proportion of toners having a circularity of 0.990 or more exceeds 25 percent by the number.

Moreover, the average circularity of a toner including toner particles obtained by a pulverization method in the related art becomes lower than 0.960. As a means for increasing the average circularity of the toner including toner particles obtained by the pulverization method, spheronization of toner particles with a heat treatment apparatus is mentioned. However, if a common heat treatment apparatus is used, the average circularity of the toner becomes 0.960 or more, and 0.985 or less, but the number of particles of 0.990 or more becomes more than 25 percent by the number. This will be described later in detail.

The materials usable for the toner according to the present invention will be described below.

The binder resins used for the toner according to the present invention are materials as described below. Homopolymers of styrene derivatives, e.g., polystyrenes and polyvinyl toluenes, styrene based copolymers, e.g., styrene-propylene copolymers, styrene-vinyl toluene copolymers, styrene-vinyl naphthalene copolymers, styrene-methyl acrylate copolymers, styrene-ethyl acrylate copolymers, styrene-butyl acrylate copolymers, styrene-octyl acrylate copolymers, styrene-dimethylaminoethyl acrylate copolymers, styrene-methyl methacrylate copolymers, styrene-ethyl methacrylate copolymers, styrene-butyl methacrylate copolymers, styrene-octyl methacrylate copolymers, styrene-dimethylaminoethyl methacrylate copolymers, styrene-vinyl methyl ether copolymers, styrene-vinyl ethyl ether copolymers, styrene-vinyl methyl ketone copolymers, styrene-butadiene copolymers, styrene-isoprene copolymers, styrene-maleic acid copolymers, and styrene-maleic acid ester copolymers, polymethyl methacrylates, polybutyl methacrylates, polyvinyl acetates, polyethylenes, polypropylenes, polyvinyl butyrals, silicone resins, polyester resins, polyamide resins, epoxy resins, polyacrylic resins, rosin, modified rosin, terpene resins, phenol resins, aliphatic or alicyclic hydrocarbon resins, and aromatic petroleum resins. These resins may be used alone or in combination.

Among them, polymers used as the binder resin favorably are styrene based copolymers and the resins having polyester units.

The above-described "polyester unit" refers to a site derived from a polyester. As for the components constituting the polyester unit, dihydric or higher alcohol monomer components and acid monomer components, e.g., divalent or higher carboxylic acids, divalent or higher carboxylic acid anhydrides, and divalent or higher carboxylic acid esters, are mentioned.

The dihydric or higher alcohol monomer components are materials as described below.

The dihydric alcohol monomer components are alkylene oxide adducts of bisphenol A, e.g., polyoxypropylene(2.2)-2,2-bis(4-hydroxyphenyl)propane, polyoxypropylene(3.3)-2,2-bis(4-hydroxyphenyl)propane, polyoxyethylene(2.0)-2,2-bis(4-hydroxyphenyl)propane, polyoxypropylene(2.0)-polyoxyethylene(2.0)-2,2-bis(4-hydroxyphenyl)propane, and polyoxypropylene(6)-2,2-bis(4-hydroxyphenyl)propane, ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, polytetramethylene glycol, bisphenol A, and hydrogenated bisphenol A.

As for the trihydric or higher alcohol monomer components, sorbitol, 1,2,3,6-hexanetetrol, 1,4-sorbitan, pentaerithritol, dipentaerithritol, tripentaerithritol, 1,2,4-butanetriol, 1,2,5-pentanetriol, glycerin, 2-methylpropanetriol, 2-methyl-1,2,4-butanetriol, trymethylolethane, trimethylolpropane, and 1,3,5-trihydroxymethylbenzene are mentioned.

As for divalent carboxylic acid monomer components, aromatic dicarboxylic acids, e.g., phthalic acid, isophthalic acid, and terephthalic acid, or anhydrides thereof; alkyl dicarboxylic acids, e.g., succinic acid, adipic acid, sebacic acid, and azelaic acid, or anhydrides thereof; succinic acid substituted with an alkyl group or alkenyl group having the carbon number of 6 to 18 or anhydrides thereof; and unsaturated dicarboxylic acids, e.g., fumaric acid, maleic acid, and citraconic acid, or anhydrides thereof are mentioned.

As for trivalent or higher carboxylic acid monomer components, polyvalent carboxylic acids, e.g., trimellitic acid, pyromellitic acid, benzophenone tetracarboxylic acid, and anhydrides thereof, are mentioned.

Furthermore, as for other monomers, polyhydric alcohols and the like of oxyalkylene ethers of novolac type phenol resins are mentioned.

In the case where the above-described binder resin is used, it is preferable that the glass transition temperature (Tg) of the binder resin is 40° C. or higher, and 90° C. or lower, and further preferably 45° C. or higher, and 65° C. or lower in order to ensure the compatibility between the preservability, the low-temperature fixing performance, and the high-temperature offset resistance.

The waxes used for the toner according to the present invention are materials as described below. Hydrocarbon based waxes, e.g., low-molecular weight polyethylenes, low-molecular weight polypropylenes, alkylene copolymers, microcrystalline waxes, paraffin waxes, and Fischer-Tropsch waxes; oxides of hydrocarbon based waxes, e.g., oxidized polyethylene waxes, or block copolymers thereof; waxes containing fatty acid esters as primary components, e.g., carnauba wax; and partly or wholly deacidified fatty acid esters, e.g., deacidified carnauba wax.

Moreover, the following are mentioned. Saturated straight-chain fatty acids, e.g., palmitic acid, stearic acid, and montanic acid; unsaturated fatty acids, e.g., brassidic acid, eleostearic acid, and parinaric acid; saturated alcohols, e.g., stearyl alcohol, aralkyl alcohol, behenyl alcohol, carnaubyl alcohol, ceryl alcohol, and melissyl alcohol; polyhydric alcohols, e.g., sorbitol; esters of fatty acids, e.g., palmitic acid, stearic acid, behenic acid, and montanic acid, and alcohols, e.g., stearyl alcohol, aralkyl alcohol, behenyl alcohol, carnaubyl alcohol, ceryl alcohol, and melissyl alcohol; fatty acid amides, e.g., linoleamide, oleamide, and lauramide; saturated fatty acid bis-amides, e.g., methylene-bis-stearamide, ethylene-bis-capramide, ethylene-bis-lauramide, and hexamethylene-bis-stearamide; unsaturated fatty acid amides, e.g., ethylene-bis-oleamide, hexamethylene-bis-oleamide, N,N'-dioleyl adipamide, and N,N'-dioleyl sebacamide; aromatic bis-amides, e.g., m-xylene-bis-stearamide and N,N'-distearyl isophthlamide; aliphatic metal salts (those generally referred to as metallic soaps), e.g., calcium stearate, calcium laurate, zinc stearate, and magnesium stearate; waxes which are aliphatic hydrocarbon based waxes grafted by using vinyl based monomers, e.g., styrene and acrylic acid; partly esterified products of fatty acids and polyhydric alcohols, e.g., behenic monoglyceride; and methyl ester compounds which are obtained by hydrogenation of vegetable oils and fats and which have hydroxyl groups.

Among these waxes, hydrocarbon based waxes, e.g., paraffin waxes and Fischer-Tropsch waxes, are preferable because toner scattering in the periphery of fine-line image and the stress resistance are improved.

In the present invention, it is preferable that 0.5 parts by mass or more, and 20 parts by mass or less of wax is used relative to 100 parts by mass of binder resin. The peak temperature of a maximum endothermic peak of the wax is preferably 45° C. or higher, and 140° C. or lower because the compatibility between the toner preservability, the low-temperature fixing performance, and the high-temperature offset resistance can be ensured. In this regard, it is further preferable that the peak temperature of a maximum endothermic peak of the wax is 75° C. or higher, and 120° C. or lower from the viewpoint of improvement of the stress resistance of the toner. As for a colorant used for the toner, the following are mentioned. As for a black colorant, carbon black; and a colorant subjected to tone adjustment to black by using a yellow colorant, magenta colorant, and cyan colorant are mentioned. A pigment may be used alone for the colorant. However, it is more preferable that a dye and a pigment are used in combination so as to improve the definition from the viewpoint of the image quality of a full color image.

As for a coloring pigment for a magenta toner, publicly known materials, e.g., condensed azo compounds, diketopyrrolopyrrole compounds, anthraquinone, quinacridone compounds, basic dye lake compounds, naphthol compounds, benzimidazolone compounds, thioindigo compounds, and perylene compounds, are used, and C. I. Pigment Red 57:1, 122, 150, and 269 are mentioned. As for a magenta toner dye, publicly known materials are used.

As for a coloring pigment for a cyan toner, copper phthalocyanine pigments, e.g., C. I. Pigment Blue 15:3, in which 1 to 5 phthalimidomethyl groups have substituted on the phthalocyanine skeleton, are mentioned. As for coloring dye for cyan, C. I. Solvent Blue 70 is mentioned.

As for a coloring pigment for yellow, compounds typified by condensed azo compounds, isoindolinone compounds, anthraquinone compounds, azo metal complex methine compounds, and allylamide compounds are used, and C. I. Pigment Yellow 74, 155, and 180 are mentioned. As for coloring dye for yellow, C. I. Solvent Yellow 162 is mentioned.

As for the usage of the colorant, it is preferable that 0.1 parts by mass or more, and 30 parts by mass or less is employed relative to 100 parts by mass of binder resin.

If necessary, a charge control agent can be contained in the toner. As for the charge control agent contained in the charge control agent, publicly known materials can be used. In particular, colorless metal compounds of aromatic carboxylic acid are preferable, wherein the speed of triboelectric charging of the toner is high and, in addition, a constant amount of triboelectric charge can be held stably.

As for a negative charge control agent, salicylic acid metal compounds, naphthoic acid metal compounds, dicarboxylic acid metal compounds, polymer type compounds having sulfonic acid or carboxylic acid in a side chain, polymer type compounds having a sulfonic acid salt or an esterified sulfonic acid in a side chain, polymer type compounds having a carboxylic acid salt or an esterified carboxylic acid in a side chain, boron compounds, urea compounds, silicon compounds, and calixarenes are mentioned. As for a positive charge control agent, quaternary ammonium salts, polymer type compounds having the above-described quaternary ammonium salt in a side chain, guanidine compounds, and imidazole compounds are mentioned. The charge control agent may be added to the toner particles internally, or be added externally. It is preferable that the amount of addition of the charge control agent is 0.2 parts by mass or more, and 10 parts by mass or less relative to 100 parts by mass of binder resin.

Examples of methods for producing the toner particles include a pulverization method, in which a binder resin and a wax are melt-kneaded, the melt-kneaded material is cooled and, thereafter, pulverization and classification are performed; a suspension granulation method, in which a solution prepared by dissolving or dispersing a binder resin and a wax into a solvent is introduced into an aqueous medium to effect suspension granulation, and the solvent is removed, so as to obtain toner particles; a suspension polymerization method, in which a monomer composition prepared by uniformly dissolving or dispersing a wax or the like into a monomer is dispersed into a continuous layer (for example, a water layer) containing a dispersion stabilizer, and a polymerization reaction is effected, so as to form toner particles; a dispersion polymerization method, in which toner particles are directly formed by using a monomer and an aqueous organic solvent, the monomer being soluble but becoming insoluble by forming a polymer and the aqueous organic solvent being soluble into the monomer to directly form toner particles by using the aqueous organic solvent and being unable to dissolve the resulting polymer; an emulsion polymerization method, in which toner particles are directly formed in the presence of a water-soluble polar polymerization initiator; and an emulsion aggregation method, in which toner particles are obtained through a step to form fine particle aggregates by aggregating at least polymer fine particles and a wax and an aging step to effect fusion between fine particles in the fine particle aggregates are mentioned.

The procedure of toner production in the pulverization method will be described below. In a raw material mixing step, predetermined amounts of a binder resin, a wax and, as necessary, other components, e.g., a colorant and a charge control agent, are weighed, formulated, and mixed as materials for constituting toner particles. As for a mixing apparatus, a double cone mixer, a V-type mixer, a drum type mixer, a super mixer, a Henschel mixer, a Nauta mixer, and MECHANO HYBRID (produced by NIPPON COKE & ENGINEERING CO., LTD.) are mentioned. Subsequently, the mixed materials are melt-kneaded, so as to disperse wax and the like into the binder resin. In the melt-kneading step thereof, a batch type kneader or a continuous kneader, such as, a pressure kneader and a Banbury mixer, can be used. A single screw or twin screw extruder has become main stream because of superiority in possibility of continuous production. As for the kneader, KTK TYPE TWIN SCREW EXTRUDER (produced by Kobe Steel, Ltd.), TEM Type Twin Screw Compounder (produced by TOSHIBA MACHINE CO., LTD.), PCM Extruder (produced by Ikegai Machinery Co.), Twin Screw Extruder (produced by K•C•K), Co-Kneader (produced by Buss), and KNEADEX (produced by NIPPON COKE & ENGINEERING CO., LTD.) are mentioned. Furthermore, a resin composition obtained by the melt-kneading may be rolled with twin rolls or the like and be cooled with water or the like in a cooling step.

Then, the cooled product of the resin composition is pulverized to have a desired particle diameter in a pulverization step. In the pulverization step, after coarse grinding with a grinder, e.g., a crasher, a hammer mill, and a feather mill, pulverization is further performed with Kryptron System (produced by Kawasaki Heavy Industries Ltd.), Super Rotor (produced by NISSHIN ENGINEERING INC.), Turbo•Mill (produced by TURBO KOGYOU CO., LTD.), or a pulverizer of an air jet system. Thereafter, as necessary, classification is performed by using a classifier or a sieving machine, such as Elbow-Jet (produced by Nittetsu Mining Co., Ltd.) of an inertial classification system, Turboplex (produced by Hosokawa Micron Corporation) of a centrifugal classification system, TSP separator (produced by Hosokawa Micron Corporation), and Faculty (produced by Hosokawa Micron Corporation), so as to obtain toner particles. Moreover, after pulverization, a surface treatment, e.g., a treatment to spheronize, of the toner particles may also be performed, as necessary, by using Hybridization System (produced by NARA MACHINERY CO., LTD.), Mechanofusion system (produced by Hosokawa Micron Corporation), Faculty (produced by Hosokawa Micron Corporation), and Meteo Rainbow MR Type (produced by NIPPON PNEUMATIC MFG. CO., LTD).

Figure 1B:
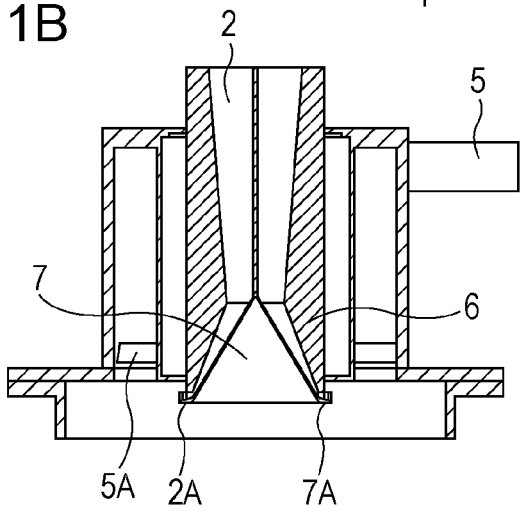
Figure 1C:
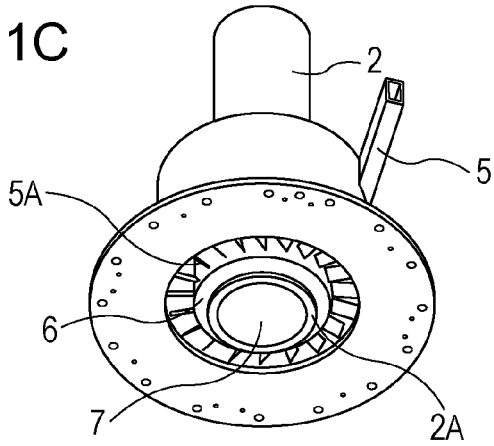

In order to obtain the toner according to the present invention, it is preferable that the toner particles obtained by the above-described pulverization method are subjected to a surface treatment with hot air by using a heat treatment apparatus shown in FIG. 1, followed by classification. The heat treatment apparatus shown in FIG. 1 will be described below.

Toner particles supplied to a raw material supply device 5 are accelerated by a compressed gas supplied from a compressed gas supply device (not shown in the drawing), and is ejected into an apparatus through an adjustment portion disposed at an outlet portion of the raw material supply device 5. The above-described adjustment portion has a louver configuration and is rotated in the apparatus when the raw material passes through. A hot air supply device is disposed in an axial center portion of the apparatus. The hot air is passed through a space formed by a first nozzle 6 and a second nozzle 7 and is ejected toward the outside raw material in the radius direction in the apparatus. A turn-up portion is disposed at a lower end portion of the second nozzle 7 in such a way that the hot air is pointed toward the raw material further reliably. In addition, a gas stream adjustment portion 2A is disposed at an outlet portion of the hot air supply device in such a way that when the hot air is passed through, the hot air is rotated in the apparatus. For example, the gas stream adjustment portion 2A is formed from louvers or slits, or ribs are disposed on the second nozzle 7, which can be selected appropriately. In this regard, the direction of rotation of the hot air is configured to become the same as the direction of rotation of the raw material.

In the present apparatus, cold air supply devices 3 and 4 to cool the heat-treated toner and prevent coalescence or fusion of toner particles due to temperature increase in the apparatus are disposed on the downstream sides of the hot air supply device 2 and the raw material supply device 5. The cold air supply devices 3 and 4 are configured to supply from the outer-area of the apparatus and from the horizontal and tangential direction.

Moreover, for the purpose of preventing fusion of toner particles in the use of the apparatus according to the present invention as a hot-spheronizing apparatus, cooling jackets are disposed on the inner-area of the raw material supply device 5, the outer-area of the apparatus, the outer-area of the hot air supply device 2, and the outer-area of a recovery device 8. In this regard, it is desirable that cooling water (preferably an antifreeze solution, e.g., ethylene glycol) is introduced into the cooling jackets.

It is preferable that the temperature C (° C.) at the outlet portion of the hot air supply device 2 of the hot air supplied into the apparatus is $100 \leqq C \leqq 450$. In the case where the temperature C (° C.) is within the above-described range, variations in heat treatment of toner particles do not occur easily, and coalescence or fusion between toner particles can be prevented.

The heat-treated toner is cooled with the cold air supply devices 3 and 4. At this time, it is preferable that a plurality of cold air supply devices 3 and 4 are disposed for the purpose of temperature control in the apparatus and control of surface state of the toner. The cooled toner is recovered through the recovery device 8 serving as a discharge portion. The recovery device 8 is disposed as a lowest portion of the apparatus and is configured to become nearly horizontal on the outer-area of the apparatus. The direction of connection of the discharge portion is the direction to maintain the stream due to the rotation from the upstream to the discharge portion of the apparatus. A blower (not shown in the drawing) is disposed on the downstream side of the recovery device 8 and is configured to suction and convey with the blower.

The process of spheronization of toner particles by a heat treatment in the above-described heat treatment apparatus will be described below.

The toner particles supplied to the raw material supply device 5 are conveyed by the compressed gas and, therefore, has a high flow rate to some extent, so as to be put into the apparatus while being dispersed with the adjustment portion 5A disposed at the outlet portion of the raw material supply device 5 in such a way as to be substantially rotated with vigor. The hot air supplied from the hot air supply device 2 is supplied, at the outlet portion thereof, into the apparatus with the gas stream adjustment portion 2A while being substantially rotated. The directions of rotation of the toner particles and the hot air are specified to be the same. Consequently, an occurrence of a turbulent flow in the apparatus is suppressed and, in addition, frequency of collision between toner particles is reduced because the toner particles are carried on the hot air supplied from the hot air supply device 2, so that coalescence is suppressed. Furthermore, in ejection from the raw material supply device, the toner particles are classified into large particles on the outer perimeter side of the rotating stream and small particles on the inner perimeter side on the basis of the difference in particle size. In the case where the toner particles in that state are carried on the hot air supplied from the hot air supply device 2, toner particles having large particle diameters pass flow paths having large rotational radii and toner particles having small particle diameters pass flow paths having small rotational radii. Consequently, a relatively large quantity of heat is applied to the toner particles having large particle diameters. Conversely, a relatively small quantity of heat is applied to the toner particles having small particle diameters. Therefore, an appropriate quantity of heat can be applied in accordance with the particle diameters of the toner particles.

Moreover, in the above-described heat treatment, toner particles having circle equivalent diameters of 0.50 μm or more, and 1.98 μm or less and, therefore, very small particle diameters are built up on the inner perimeter side of the rotating stream, so as to coalesce easily. Consequently, the proportion of presence of particles having circle equivalent diameters of 0.50 μm or more, and 1.98 μm or less is reduced.

Figure 2:
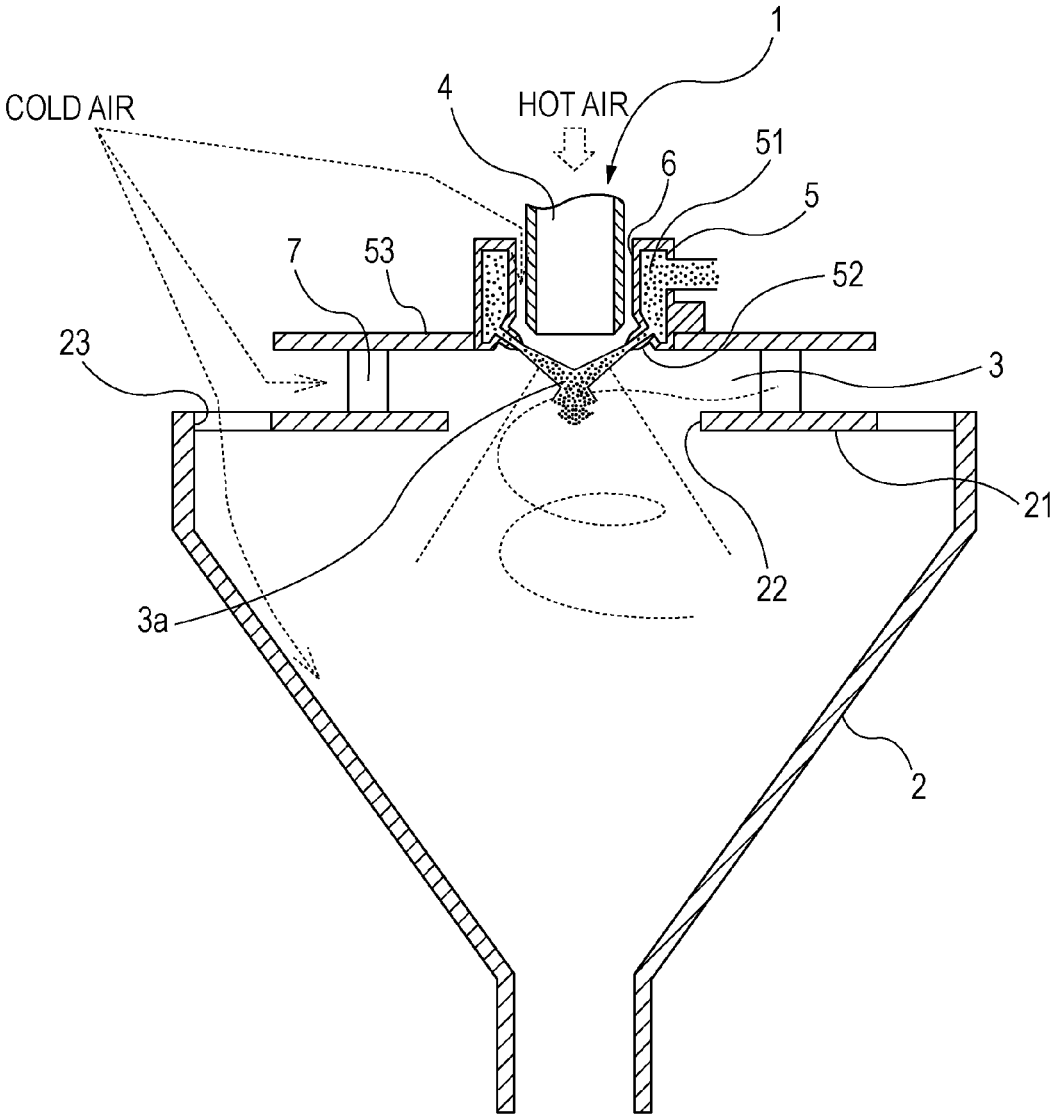
FIG. 2 is a diagram showing a heat treatment apparatus which has been used previously.

FIG. 2 is a diagram showing a heat treatment apparatus which has been used previously. In many cases, the apparatus shown in FIG. 2 has a configuration, in which regarding ejection of toner particles into the apparatus, the ejection hole has been disposed in the hot air, and the toner particles have been dispersed into the hot air with a compressed air. However, in this configuration, a quantity of heat in accordance with the particle diameters of the toner particles cannot be applied in contrast to the above-described apparatus. Furthermore, there are variations in quantities of heat applied to toner particles regardless of particle diameters of the toner particles, and the proportion of inclusion of not sufficiently heat-treated particles increases. In the case where the quantity of applied heat is increased in order to reduce the proportion of inclusion of untreated particles, the average circularity increases, but the proportion of toner particles having a circularity of 0.990 or more increases and, in addition, coalescence between toner particles occurs.

Figure 3:
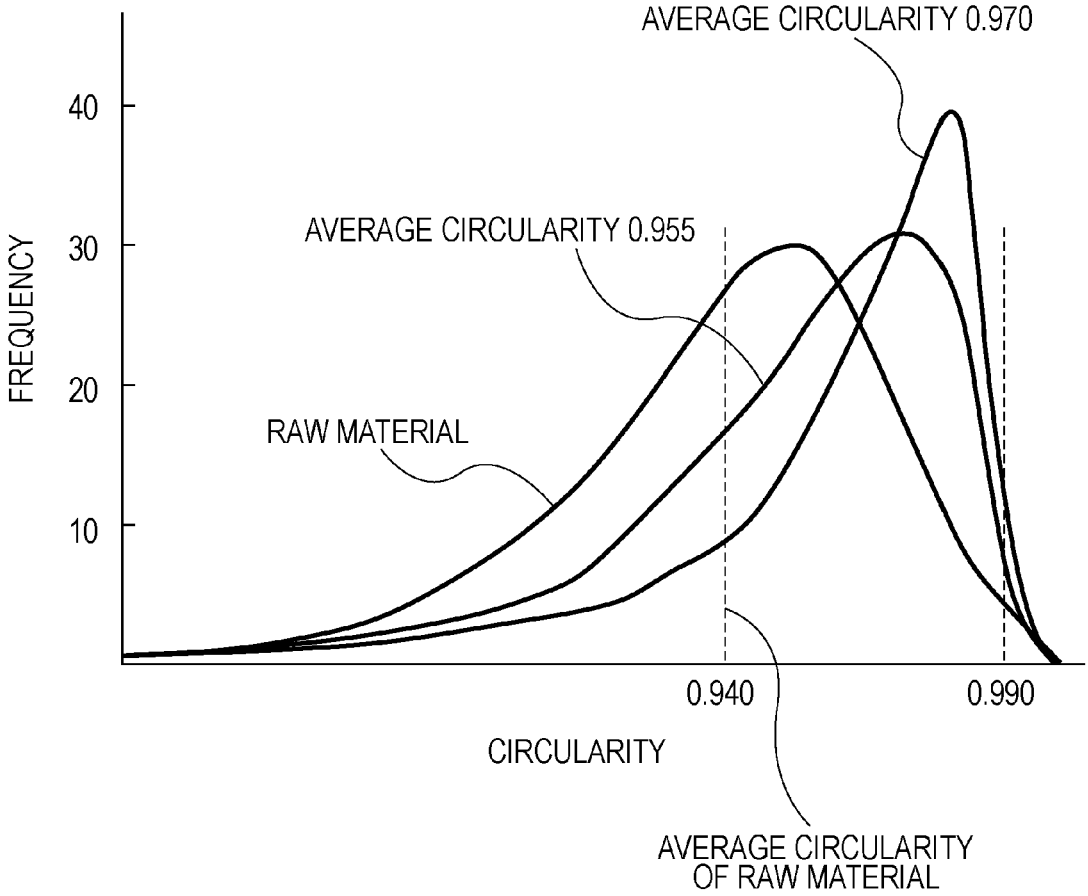
FIG. 3 is a diagram showing comparison of circularity distributions on the basis of a heat treatment apparatus.
Figure 4:
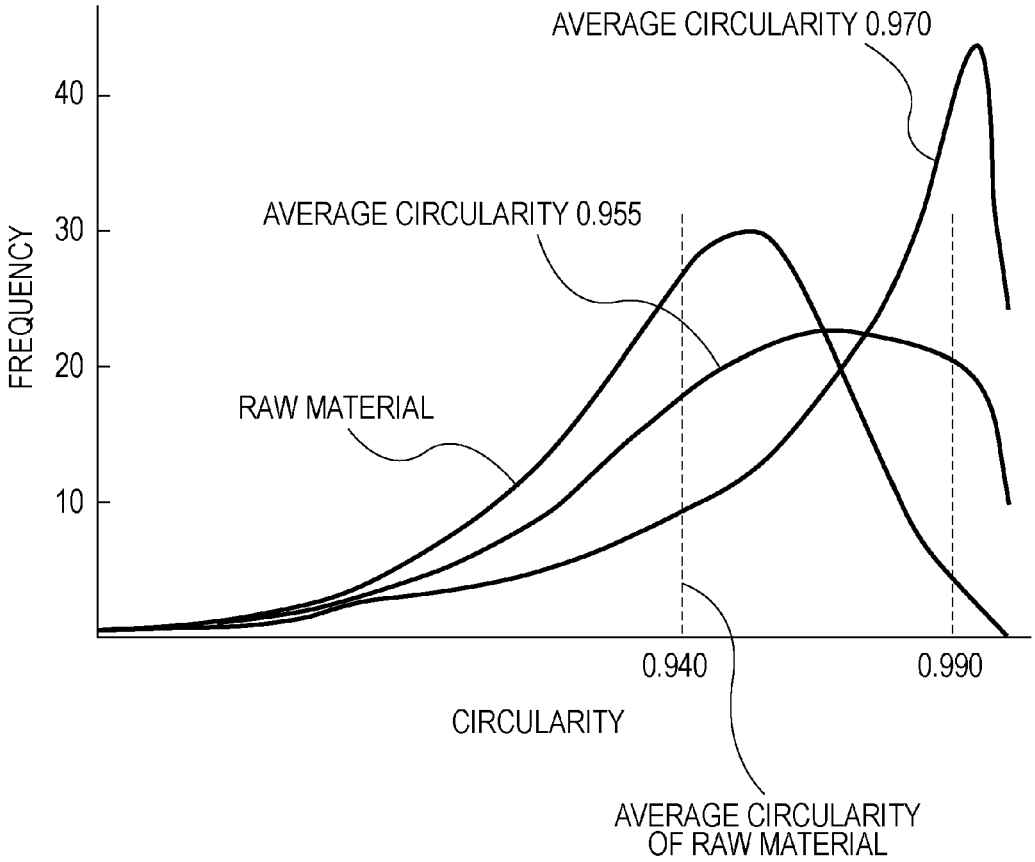
FIG. 4 is a diagram showing comparison of proportions of particles having a circularity of 0.990 or more on the basis of a heat treatment apparatus.

FIG. 3 shows changes in average circularity and circularity distribution of the toner in the case where the toner is surface-treated by using the heat treatment apparatus shown in FIG. 1. Moreover, FIG. 4 shows changes in average circularity and circularity distribution of the toner in the case where the toner is surface-treated by using the heat treatment apparatus shown in FIG. 2. In the case where a toner having an average circularity of 0.940 before the treatment is subjected to a heat treatment with the heat treatment apparatus shown in FIG. 2 in such a way that the average circularity of the toner becomes 0.970, the frequency of toner particles having circularity of 0.990 or more shows the tendency to increase (refer to FIG. 4). In addition, a difference between the value of the average circularity and the circularity showing the peak in the circularity distribution is large. On the other hand, in the case where the heat treatment is performed by using the heat treatment apparatus shown in FIG. 1, the position of the peak is not estranged from the value of the average circularity of the toner and, therefore, the frequency of toner particles having circularity of 0.990 or more can also be reduced (refer to FIG. 3). Furthermore, in the case where the time of the heat treatment is decreased and the average circularity of the toner is reduced to about 0.955, the use of the heat treatment apparatus shown in FIG. 1 indicates less frequency of toner particles having low circularity and a sharper peak shape.

In the case where toner particles are treated with the heat treatment apparatus shown in FIG. 1, regarding the toner particles before the treatment, it is preferable that the toner particles include inorganic fine particles. In this regard, it is further preferable that the heat treatment is performed after inorganic fine particles are externally added to the toner particles including inorganic fine particles in the insides of the toner particles. The fluidity of the toner particles in the heat treatment apparatus is improved by performing the heat treatment by using the toner particles including the inorganic fine particles. Consequently, aggregation of toner particles does not occur easily, and inclusion of not sufficiently heat-treated toner particles can be prevented. As a result, it becomes easy to specify the frequency of toner particles having circularity of 0.990 or more to be 25 percent by the number while the average circularity is controlled to be 0.960 or more, and 0.985 or less.

As for inorganic fine particles added before the heat treatment, silica, titanium oxide, and aluminum oxide are mentioned. It is preferable that the above-described inorganic fine particles are hydrophobized with a hydrophobizing agent, e.g., a silane compound, a silicone oil, or a mixture thereof. The amount of addition of inorganic fine particles added before the heat treatment is preferably 0.5 parts by mass or more, and 10.0 parts by mass or less relative to 100 parts by mass of toner particles.

As necessary, surface modification and a spheronization treatment may be performed by using, for example, Hybridization System produced by NARA MACHINERY CO., LTD., or Mechanofusion system produced by Hosokawa Micron Corporation. Furthermore, a sieving machine, e.g., a wind power sieve Hi-Bolter (produced by Shin Tokyo Kikai K.K.), may be used, as necessary.

It is preferable that external additives are further added to the toner to improve the fluidity and the durability. As for the external additive, materials similar to the above-described inorganic fine particles are mentioned. In this regard, it is preferable that the external additive has a specific surface area of 50 $m^2/g$ or more, and 400 $m^2/g$ or less to improve the fluidity. Furthermore, inorganic fine particles having a specific surface area of 10 $m^2/g$ or more, and 50 $m^2/g$ or less are preferable to stabilize the durability. In order to ensure the compatibility between the fluidity and the durability, at least two types of inorganic fine particles having a specific surface area within the above-described range may be used in combination. It is preferable that 0.1 parts by mass or more, and 5.0 parts by mass or less of external additive is used relative to 100 parts by mass of toner particles. The toner particles and the external additive can be mixed by using a publicly known mixer, e.g., a Henschel mixer.

The toner according to the present invention can also be used as a one-component developer, but is preferably mixed with a magnetic carrier and is used as a binary developer in order to further improve the dot reproducibility and obtain stable images over the long term. Regarding the magnetic carrier combined with the toner according to the present invention, the true specific gravity of the magnetic carrier is preferably 3.2 $g/cm^3$ or more, and 4.9 $g/cm^3$ or less and, further preferably, the true specific gravity is 3.4 $g/cm^3$ or more, and 4.2 $g/cm^3$ or less. In the case where the true specific gravity of the magnetic carrier is within the above-described range, a load applied during agitation of the developer in the developing apparatus is reduced, and toner-spent in the endurance of a high coverage rate (coverage rate: 40% or more) is suppressed. Moreover, an occurrence of fogging in a non-image area associated with a reduction in the amount of triboelectric charge is suppressed.

It is preferable that the 50% particle diameter (D50) on the basis of volume distribution of the magnetic carrier combined with the toner according to the present invention is 30.0 μm or more, and 70.0 μm or less. It is preferable that the D50 of the magnetic carrier is within the above-described range because the amount of charge of the toner is obtained stably. In addition, regarding the amount of magnetization of the magnetic carrier combined with the toner according to the present invention, the intensity of magnetization (σ1000) measured in a magnetic field of 1,000 oersted is preferably 15 Am2/kg (emu/g) or more, and 65 Am2/kg (emu/g) or less from the viewpoint of maintenance of the developing property and the stability in durability.

As for the magnetic carrier, for example, metal particles, e.g., iron, lithium, calcium, magnesium, nickel, copper, zinc, cobalt, manganese, chromium, and rare-earths, alloy particles and oxide particles thereof, magnetic substances, e.g., ferrite, and magnetic substance-dispersed resin carriers (so-called resin carriers) containing the magnetic substance and a binder resin holding the magnetic substance in a dispersed state can be used.

In the case where the toner according to the present invention is mixed with the magnetic carrier and is used as a binary developer, a good result is obtained when the toner concentration in the developer is 2 percent by mass or more, and 15 percent by mass or less, and preferably 4 percent by mass or more, and 13 percent by mass or less.

An image forming method in an electrophotographic apparatus will be described. An electrophotographic photosensitive member (image bearing member) is driven to rotate at a predetermined peripheral speed and the surface is positively or negatively charged by a charging means during rotation (charging step). Subsequently, the electrophotographic photosensitive member undergoes exposure (slit exposure, laser beam scanning exposure, or the like) by an exposing means. Consequently, an electrostatic latent image in accordance with an exposed image is formed on a photosensitive member surface (latent image forming step). A toner is supplied from a development sleeve to the electrophotographic photosensitive member bearing the latent image and, thereby, a toner image is developed (developing step). The toner image is transferred to a transfer-receiving member by a transfer means (transferring step). The toner image may be transferred to the transfer-receiving member through or not through an intermediate transfer member. After the transfer-receiving member is separated from the photosensitive member surface, the toner image is fixed to the transfer-receiving member by heat or pressure due to an image fixing means and is output as a duplicate to the outside of the apparatus. Regarding the surface of the electrophotographic photosensitive member after the transfer of the image, a transfer residual toner is removed by a cleaning means (cleaning step).

It is preferable that the toner according to the present invention is used for an image forming method including a blade cleaning step, in which cleaning is performed by bringing a blade into contact with the surface of an image bearing member. For example, in the case where a toner having a large average circularity and including a large proportion of toner particles having circularity of 0.990 or more, such as, a toner including toner particles obtained by a suspension polymerization method, is used, the toner slips through a gap between the image bearing member and the cleaning blade easily, so that the cleanability is not good. The initial cleanability is improved by using an image bearing member having a large elastic deformation rate so as to increase an average contact surface pressure of a contact nip portion of the image bearing member and the cleaning blade. However, after endurance, a tendency of the cleanability to degrade because of vibration of the blade is observed.

On the other hand, in the case where the toner according to the present invention is used, the proportion of particles having circularity of 0.990 or more is small and, therefore, the cleanability is good, so that an image bearing member having a relatively low elastic deformation rate can be used. In general, if the elastic deformation rate of the image bearing member is low, the cleanability is degraded, but the durability is excellent. In the case where the toner according to the present invention is used, an image bearing member having a relatively low elastic deformation rate can be used and, thereby, the cleanability stable over the long term can be obtained. Furthermore, the toner according to the present invention has high average circularity as compared with that of the toner obtained by the pulverization method in the related art and, therefore, is excellent in the transferability and the developing property in addition to the cleanability.

It is preferable that the elastic deformation rate of the surface of the image bearing member is 40% or more, and 70% or less. In the case where the elastic deformation rate of the surface of the image bearing member is within the above-described range, the image bearing member surface is not worn easily and is highly durable. In addition, vibration of the cleaning blade and turning up of the cleaning blade associated with an increase in frictional resistance of the cleaning blade do not occur easily. It is further preferable that the elastic deformation rate of the surface of the image bearing member is 45% or more, and 60% or less.

It is preferable that the contact surface pressure between the cleaning blade and the photosensitive member is 10 kgf/$cm^2$ or more, and 30 kgf/$cm^2$ or less. It is favorable to increase the contact surface pressure between the cleaning blade and the photosensitive member in order that a transfer residual toner on the image bearing member does not slip through the cleaning blade easily. However, if the pressure between the cleaning blade and the image bearing member becomes too high, in the endurance, particularly in a high-temperature high-humidity environment (temperature 32.5° C., humidity 80% RH), the frictional resistance between the cleaning blade surface and the image bearing member surface increases and an excessive load is applied to the cleaning blade. If an excessive load is applied to the cleaning blade, chipping of an edge of the cleaning blade or turning up of the cleaning blade may occur, and defective cleaning may occurs because of chipping of an edge or turning up of the cleaning blade. This phenomenon tends to occur remarkably as the friction coefficient μ of the material of the outermost surface layer on the electrophotographic photosensitive member becomes high because the frictional resistance between the cleaning blade and the electrophotographic photosensitive member becomes high.

Moreover, it is preferable that the surface of the image bearing member is a resin cured by polymerizing or cross-linking a compound having a polymerizable functional group (hereafter may be referred to as a curable resin). Consequently, the durability of the image bearing member is further improved. As for a cross-linking method, a method in which a monomer or an oligomer having a polymerizable functional group is contained in a paint in formation of the image bearing member, film formation and drying are performed and, thereafter, polymerization of the resulting film is effected by heating and application of radiation or electron beam is mentioned.

Even when the average contact surface pressure of the contact nip portion is increased, an increase in frictional resistance of the cleaning blade can be suppressed by combining the above-described image bearing member and the toner according to the present invention. As a result, vibration of the cleaning blade and turning up of the cleaning blade can be suppressed and corona products (NOx and ozone) can be scraped off by a discharge current between the charging roller and the image bearing member. Consequently, image deletion due to corona products can be suppressed.

The surface containing the above-described curable resin may have a charge transport function or have no charge transport function. The outermost surface layer containing the curable resin and having the charge transport function is treated as a part of the photosensitive layer. In the case where no charge transport function is provided, the outermost surface layer is referred to as a protective layer (or surface protective layer), as described below, and is distinguished from a photosensitive layer.

As for a layer configuration of a photosensitive layer of the image bearing member, any one of the configuration of a normal lamination layer configuration, in which charge generation layer/charge transport layer are laminated in that order from an electrically conductive support side, a reverse lamination layer configuration, in which charge transport layer/charge generation layer are laminated in that order from an electrically conductive support side, or a configuration formed from a single layer, in which a charge generation material and a charge transport material are dispersed in the same layer, can be employed.

In the photosensitive layer composed of a single layer, generation and movement of a photo carrier are performed in the same layer, and the photosensitive layer in itself serves as the surface layer. On the other hand, the photosensitive layer composed of laminated layers has a configuration in which a charge generation layer for generation of a photo carrier and a charge transport layer for movement of the generated carrier are laminated.

The most preferable layer configuration is the normal lamination layer configuration, in which charge generation layer/charge transport layer are laminated in that order from the electrically conductive support side.

In this case, any one of the image bearing member in which the charge transport layer is the outermost surface layer composed of a single layer containing a curable resin or the image bearing member in which the charge transport layer is of a lamination type composed of a non-curable first layer and a curable second layer and the curable second layer serves as the outermost surface layer is preferable.

In this regard, in both cases of the single layer and laminated layers, it is possible to dispose a protective layer as a layer on the photosensitive layer. In this case, it is preferable that the protective layer contains the curable resin.

<Method for Measuring Average Circularity of Toner, Percentage by the Number of particles of 0.50 μm or More, and 1.98 μm or Less, and Percentage by the Number of Particles having Circularity of 0.990 or More>

The average circularity of the toner according to the present invention, the percentage by the number of particles having a circle equivalent diameter of 0.50 μm or more, and 1.98 μm or less, and the percentage by the number of particles having a circularity of 0.990 or more are measured with a flow particle image analyzer "FPIA-3000" (produced by SYSMEX CORPORATION).

A specific measuring method is as described below. Initially, about 20 ml of ion-exchanged water, from which impurity solids and the like have been removed in advance, is put into a glass container. About 0.2 ml of diluted solution, in which "Contaminon N" (a 10 percent by mass aqueous solution of neutral detergent for washing a precision measuring apparatus including a nonionic surfactant, an anionic surfactant, and an organic builder, and having a pH of 7, produced by Wako Pure Chemical Industries, Ltd.) is diluted with ion-exchanged water by a factor of about 3 on a mass basis, serving as a dispersing agent is added thereto. Furthermore, about 0.02 g of measurement sample is added and a dispersing treatment is performed for 2 minutes by using an ultrasonic dispersing machine, so as to prepare a dispersion for measurement. At that time, cooling is performed appropriately in such a way that the temperature of the dispersion becomes 10° C. or higher, and 40° C. or lower. As for the dispersing machine, a desktop ultrasonic cleaning and dispersing machine having an oscillatory frequency of 50 kHz and an electrical output of 150 W (for example, "VS-150" (produced by VELVO-CLEAR)) is used. A predetermined amount of ion-exchanged water is put into a water tank and about 2 ml of Contaminon N described above is added to this water tank.

In the measurement, the above-described flow particle image analyzer equipped with a standard objective lens (10 times) is used, and PARTICLE SHEATH "PSE-900A" (produced by SYSMEX CORPORATION) is used as a sheath liquid. The dispersion prepared following the above-described procedure is introduced into the above-described flow particle image analyzer, and 3,000 toner particles are measured according to a total count mode in HPF measurement mode. Then, a binarization threshold value in particle analysis is specified to be 85%, the analyzed particle diameter is designated and, thereby, the percentage by the number (%) and the average circularity of particles within that range can be calculated. Regarding the average circularity of the toner, the range of the analyzed particle diameter on a circle equivalent diameter basis is specified to be 1.98 μm or more, and 200.00 μm or less, and the average circularity of the toner is determined. Regarding the proportion of particles having circularity of 0.990 or more, and 1.000 or less, the range of the analyzed particle diameter on a circle equivalent diameter basis is specified to be 1.98 μm or more, and 200.00 μm or less, and the percentage by the number (%) of particles included in that range is calculated. Regarding the proportion of particles (small particles) having a circle equivalent diameter of 0.50 μm or more, and 1.98 μm or less, the range of the analyzed particle diameter on a circle equivalent diameter basis is specified to be 0.50 μm or more, and 1.98 μm or less, and the percentage by the number (%) of particles included in that range is calculated.

In the measurement, automatic focal point adjustment is performed prior to the start of the measurement by using standard latex particles (for example, "RESEARCH AND TEST PARTICLES Latex Microsphere Suspensions 5200A" produced by Duke Scientific is diluted with ion-exchanged water). Thereafter, it is preferable that the focal point adjustment is performed every two hours after the start of the measurement.

In this regard, in the example of the present invention, a flow particle image analyzer that had been calibrated by SYSMEX CORPORATION and that had been issued a calibration certificate by SYSMEX CORPORATION was used. The measurements were performed under the same measurement and analysis conditions as those when the calibration certificate was received except that the analyzed particle diameter was limited to a circle equivalent diameter of 0.50 μm or more, and less than 1.98 μm or 1.98 μm or more, and less than 200.00 μm.

<Method for Measuring Weight Average Molecular Weight (Mw) and Peak Molecular Weight (Mp) of Resin>

The weight average molecular weight (Mw) and the peak molecular weight (Mp) of the resin are measured with gel permeation chromatography (GPC) as described below.

Initially, a sample (resin) is dissolved into tetrahydrofuran (THF) at room temperature over 24 hours. Subsequently, the resulting solution is filtrated with a solvent-resistant membrane filter "Maishori Disk" (produced by Tosoh Corporation) having a pore diameter of 0.2 μm to obtain a sample solution. In this regard, the sample solution is adjusted in such a way that the concentration of a component soluble in THF becomes about 0.8 percent by mass. The measurement is performed by using the resulting sample solution under the following conditions.

Apparatus: HLC8120 GPC (detector: RI) (produced by Tosoh Corporation)

Column: seven-gang Shodex KF-801, 802, 803, 804, 805, 806, and 807 (produced by SHOWA DENKO K.K.)

Elution solution: THF

Flow rate: 1.0 ml/min

Oven temperature: 40.0° C.

Amount of injection of sample: 0.10 ml

In calculation of the molecular weight of the sample, a molecular weight calibration curve prepared by using standard polystyrenes (for example, trade name "TSK Standard Polystyrene F-850, F-450, F-288, F-128, F-80, F-40, F-20, F-10, F-4, F-2, F-1, A-5000, A-2500, A-1000, and A-500", produced by Tosoh Corporation) is used.

<Measurement of Maximum Endothermic Peak of Wax>

The maximum endothermic peak of wax is measured on the basis of ASTM D3418-82 by using a differential scanning calorimeter "Q1000" (produced by TA Instruments). Regarding temperature correction of an apparatus detection portion, melting points of indium and zinc are used. Regarding correction of the quantity of heat, the heat of fusion of indium is used.

The measurement of the maximum endothermic peak of the wax is performed as specifically described below.

About 5 mg of wax is precisely weighed and is put into an aluminum pan. The measurement is performed at a measurement temperature within the range of 30° C. to 200° C. and at a temperature rising rate of 10° C./min while an empty aluminum pan is used as a reference. In this regard, in the measurement, the temperature is once raised to 200° C. Subsequently, the temperature is lowered to 30° C. and, thereafter, the temperature is raised again. A maximum endothermic peak of the DSC curve in the temperature range of 30° C. to 200° C. in this second temperature raising process is assumed to be the maximum endothermic peak of the endothermic curve in the DSC measurement of the wax used in the present invention.

<Method for Measuring Weight Average Particle Diameter (D4) and Number Average Particle Diameter (D1)>

The weight average particle diameter (D4) and the number average particle diameter (D1) of the toner are calculated as described below. As for the measuring apparatus, a precise particle size distribution measurement apparatus "Coulter Counter Multisizer 3" (registered trade mark, produced by Beckman Coulter, Inc.) equipped with a 100 μm aperture tube on the basis of a pore electrical resistance method is used. Regarding setting of the measurement conditions and analysis of the measurement data, an attached dedicated software "Beckman Coulter Multisizer 3 Version 3.51" (produced by Beckman Coulter, Inc.) is used. In this regard, the measurement is performed with the number of effective measurement channels of 25,000 channels.

As for the electrolytic aqueous solution used for the measurement, a solution prepared by dissolving special grade sodium chloride into ion-exchanged water in such a way as to have a concentration of about 1 percent by mass, for example, "ISOTON II" (produced by Beckman Coulter, Inc.), can be used.

By the way, prior to the measurement and the analysis, the above-described dedicated software is set as described below.

In the screen of "modification of the standard operating method (SOM)" of the above-described dedicated software, the total count number in the control mode is set at 50,000 particles, the number of measurements is set at 1 time, and the Kd value is set at a value obtained by using the "standard particles 10.0 μm" (produced by Beckman Coulter, Inc.). The threshold value and the noise level are automatically set by pressing the "threshold value/noise level measurement button". In addition, the current is set at 1,600 μA, the gain is set at 2, the electrolytic solution is set at ISOTON II, and a check is entered in the "post-measurement aperture tube flush".

In the screen of "setting of conversion from pulses to particle diameter" of the above-described dedicated software, the bin interval is set at logarithmic particle diameter, the particle diameter bin is set at 256 particle diameter bins, and the particle diameter range is set at 2 μm to 60 μm.

The specific measurement procedure is as described below.

(1) About 200 ml of the above-described electrolytic aqueous solution is put into a 250 ml round-bottom glass beaker dedicated to Multisizer 3, the beaker is set in a sample stand, and counterclockwise agitation is performed with a stirrer rod at 24 rotations/sec. Then, contamination and air bubbles in the aperture tube are removed by the "aperture flush" function of the dedicated software.

(2) About 30 ml of the above-described electrolytic aqueous solution is put into a 100 ml flat-bottom glass beaker. About 0.3 ml of diluted solution, in which "Contaminon N" (a 10 percent by mass aqueous solution of neutral detergent for washing a precision measuring apparatus including a nonionic surfactant, an anionic surfactant, and an organic builder, and having a pH of 7, produced by Wako Pure Chemical Industries, Ltd.) is diluted with ion-exchanged water by a factor of about 3 on a mass basis, serving as a dispersing agent is added thereto.

(3) An ultrasonic dispersing machine "Ultrasonic Dispersion System Tetora 150" (produced by Nikkaki Bios Co., Ltd.) having an electrical output of 120 W and including two oscillators having an oscillatory frequency of 50 kHz in such a way that the phases are displaced by 180 degrees is prepared. About 3.3 l of ion-exchanged water is put into a water tank of the ultrasonic dispersing machine, and about 2 ml of Contaminon N is added to this water tank.

(4) The beaker in the above-described item (2) is set into a beaker fixing hole of the above-described ultrasonic dispersing machine, and the ultrasonic dispersing machine is actuated. Then, the height position of the beaker is adjusted in such a way that the resonance condition of the liquid surface of the electrolytic aqueous solution in the beaker becomes at a maximum.

(5) Ultrasonic waves are applied to the electrolytic aqueous solution in the beaker of the above-described item (4). In this state, about 10 mg of toner is added to the above-described electrolytic aqueous solution little by little and is dispersed. Subsequently, an ultrasonic dispersion treatment is further continued for 60 seconds. In this regard, in the ultrasonic dispersion, the water temperature of the water tank is adjusted appropriately in such a way as to become 10° C. or higher, and 40° C. or lower.

(6) The electrolytic aqueous solution, in which the toner is dispersed, of the above-described item (5) is dropped to the round-bottom beaker of the above-described item (1) set in the sample stand by using a pipette in such a way that the measurement concentration is adjusted to be about 5%. Then, the measurement is performed until the number of measured particles reaches 50,000.

(7) The measurement data are analyzed by the above-described dedicated software accompanying the apparatus, so that the weight average particle diameter (D4) and the number average particle diameter (D1) are calculated. In this regard, when graph/percent by volume is set in the above-described dedicated software, the "average diameter" on the screen of the "analysis/statistical value on volume (arithmetic average)" is the weight average particle diameter (D4), and when graph/percent by the number is set in the above-described dedicated software, the "average diameter" on the screen of the "analysis/statistical value on the number (arithmetic average)" is the number average particle diameter (D1).

<Method for Calculating Amount of Fine Particles (Particles of 4.0 μm or Less)>

The amount of fine particles (particles of 4.0 μm or less) in the toner on the number basis (percent by the number) is calculated by performing the measurement with Multisizer 3 described above and analyzing the data.

The percentage by the number of particles of 4.0 μm or less in the toner is calculated by the following procedure. Initially, in the above-described dedicated software, graph/percent by the number is set, so that the chart of the measurement results is expressed in percent by the number. Then, a check is entered in the "<" of the particle diameter setting portion on the screen of "format/particle diameter/statistics on particle diameter", and "4" is entered in the particle diameter input portion thereunder. The value in the "<4 μm" display portion when the screen of "analysis/statistical value on the number (arithmetic average)" is displayed is the percentage by the number of particles of 4.0 μm or less in the toner.

<Method for Calculating Amount of Coarse Particles (Particles of 10.0 μm or More)>

The amount of coarse particles (particles of 10.0 μm or more) in the toner on a volume basis (percent by volume) is calculated by performing the measurement with Multisizer 3 described above and analyzing the data. The percentage by volume of particles of 10.0 μm or more in the toner is calculated by the following procedure. Initially, in the above-described dedicated software, graph/percent by volume is set, so that the chart of the measurement results is expressed in percent by volume. Then, a check is entered in the ">" of the particle diameter setting portion on the screen of "format/particle diameter/statistics on particle diameter", and "10" is entered in the particle diameter input portion thereunder. The value in the ">10 μm" display portion when the screen of "analysis/statistical value on the number (arithmetic average)" is displayed is the percentage by volume of particles of 10.0 μm or more in the toner.

<Method for Measuring Intensity of Magnetization of Magnetic Carrier and Magnetic Carrier Core Member>

The intensity of magnetization of the magnetic carrier and the magnetic carrier core member can be determined with a vibrating magnetic field type magnetic characteristics measuring apparatus (Vibrating sample magnetometer) or a direct current magnetization characteristics recording apparatus (B-H Tracer). In the examples of the present invention, the measurement is performed with a vibrating magnetic field type magnetic characteristics measuring apparatus BHV-30 (produced by Riken Denshi Co., Ltd.) in the following procedure.

(1) A cylindrical plastic container sufficiently closely filled with a carrier is employed as a sample. The actual mass of the carrier filled in the container is measured. Thereafter, the magnetic carrier particles in the plastic container are adhered with an instant adhesive in such a way that the magnetic carrier particles do not move.

(2) The external magnetic field axis and the magnetization moment axis at 5,000/4π (kA/m) are calibrated by using a standard sample.

(3) The intensity of magnetization is measured from the loop of the magnetization moment, where the sweep rate is specified to be 5 min/loop and an external magnetic field of 1,000/4π (kA/m) is applied. The results are divided by the sample weight, so as to determine the intensity of magnetization ($Am^2/kg$) of the carrier.

<Method for Measuring 50% Particle Diameter (D50) of Magnetic Carrier on a Volume Distribution Basis>

The particle size distribution is measured with a particle size distribution measuring apparatus of laser diffraction•scattering system "Microtrac MT3300EX" (produced by NIKKISO CO., LTD.). A sample feeding machine for dry measurement "One-shot dry type sample conditioner Turbotrac" (produced by NIKKISO CO., LTD.) is attached to perform the measurement. As for the supply condition of Turbotrac, a dust collector is used as a vacuum source, the air flow rate is specified to be about 33 liters/sec, and the pressure is specified to be about 17 kPa. The control is automatically performed by the software. As for the particle diameter, the 50% particle diameter (D50), which is an integral value on a volume basis, is determined. The control and the analysis are performed by using the attached software (Version 10.3.3-202D).

The measurement conditions are as described below.

SetZero time: 10 seconds
Measurement time: 10 seconds
Number of measurements: once
Particle refractive index: 1.81
Particle shape: non-spherical
Upper limit of measurement: 1,408 μm
Lower limit of measurement: 0.243 μm
Measurement environment: ambient temperature and normal humidity environment (23° C. 50% RH)<

<Method for Measuring True Specific Gravity of Magnetic Carrier>

The true specific gravity of the magnetic carrier is measured by using Micromeritics Gas Pycnometer Accupyc 1330 (produced by SHIMADZU CORPORATION). Initially, 5 g of sample left standing for 24 hours in the environment of 23° C./50% RH is precisely weighed and put into a measurement cell (10 $cm^3$). The resulting cell is inserted into a sample chamber of a main body. Regarding the measurement, automatic measurement can be performed by inputting the sample weight to the main body and starting the measurement. Regarding the measurement condition of the automatic measurement, a helium gas adjusted at 20.000 psig ($2.392\times10^2$ kPa) is used. The sample chamber is purged 10 times with the helium gas. Subsequently, the state in which a change of pressure in the sample chamber is 0.005 psig/min ($3.447\times10^{-2}$ kPa/min) is assumed to be an equilibrium state, and purge with the helium gas is repeated until the equilibrium state is reached. The pressure of the sample chamber of the main body in the equilibrium state is measured. The sample volume can be calculated from the change of the pressure when the equilibrium state is reached.

Since the sample volume can be calculated, the true specific gravity of the sample can be calculated on the basis of the following formula.

true specific gravity of sample ($g/cm^3$)=sample weight (g)/sample volume ($cm^3$)

The average value of the measurement values obtained by repeating the automatic measurement 5 times is assumed to be the true specific gravity ($g/cm^3$) of the magnetic carrier and the magnetic core.

<Measurement of Elastic Deformation Rate of Outermost Surface Layer of Electrophotographic Photosensitive Member>

The elastic deformation rate (%) is measured by using a microhardness measuring apparatus FISCHERSCOPE H100V (produced by Fischer). Specifically, a load of up to 6 mN is continuously applied to a Vickers pyramid diamond indenter which has an angle between the opposite faces of 136° and which is disposed on the surface of the outermost surface layer of the electrophotographic photosensitive member in an environment at a temperature of 25° C. and a humidity of 50% RH, and the indentation depth under the load is directly read. The measurement is performed stepwise (273 points, each point having a holding time of 0.1 S) from an initial load of 0 mN until a final load of 6 mN.

The elastic deformation rate can be determined on the basis of a workload (energy) applied by the indenter to the surface of the outermost surface layer of the electrophotographic photosensitive member when the indenter is pressed in the surface of the outermost surface layer of the electrophotographic photosensitive member, that is, the change in energy due to increase and decrease of the load of the indenter applied to the surface of the outermost surface layer of the electrophotographic photosensitive member. Specifically, the elastic deformation rate can be determined on the basis of the following Formula (1).

$$\text{elastic deformation rate (\%)} = We/Wt \times 100 \quad \text{(Formula 1)}$$

EXAMPLES

Production Example of Polyester Resin A

A 4-liter four-neck glass flask was charged with 55.1 parts by mass of polyoxypropylene(2.2)-2,2-bis(4-hydroxyphenyl)propane, 19.3 parts by mass of polyoxyethylene(2.2)-2,2-bis(4-hydroxyphenyl)propane, 8.0 parts by mass of terephthalic acid, 6.9 parts by mass of trimellitic anhydride, 10.5 parts by mass of fumaric acid, and 0.2 parts by mass of titanium tetrabutoxide, a thermometer, a stirring rod, a condenser, and a nitrogen introduction tube were attached, and the flask was placed in a mantle heater. Subsequently, the inside of the flask was substituted with a nitrogen gas and, thereafter, the temperature was raised gradually while agitation was performed. A reaction was effected for 4 hours while agitation was performed at 180° C., so that a polyester resin A was obtained. Regarding the molecular weight of the resulting polyester resin A on the basis of GPC, the weight average molecular weight (Mw) was 5,000 and the peak molecular weight (Mp) was 3,000. The softening point was 85° C.

Production Example of Polyester Resin B

A 4-liter four-neck glass flask was charged with 40.0 parts by mass of polyoxypropylene(2.2)-2,2-bis(4-hydroxyphenyl)propane, 55.0 parts by mass of terephthalic acid, 1.0 part by mass of adipic acid, and 0.6 parts by mass of titanium tetrabutoxide. A thermometer, a stirring rod, a condenser, and a nitrogen introduction tube were attached to the four-neck flask, and the above-described four-neck flask was placed in a mantle heater. Subsequently, the inside of the four-neck flask was substituted with a nitrogen gas and, thereafter, the temperature was raised to 220° C. gradually while agitation was performed, so as to effect a reaction for 8 hours. (First reaction step) Thereafter, 4.0 parts by mass (0.021 mol) of trimellitic anhydride was added, and a reaction was effected at 180° C. for 4 hours (second reaction step), so that a polyester resin B was obtained.

Regarding the molecular weight of the resulting polyester resin B on the basis of GPC, the weight average molecular weight (Mw) was 300,000, and the peak molecular weight (Mp) was 10,000. The softening point was 135° C.

Toner Production Example 1

| | |
|---|---|
| polyester resin A | 60 parts by mass |
| polyester resin B | 40 parts by mass |
| Fischer-Tropsch wax (peak temperature of maximum endothermic peak 78° C.) | 5 parts by mass |
| 3,5-di-t-butylsalicylic acid aluminum compound | 0.5 parts by mass |
| C.I. Pigment Blue 15:3 | 5 parts by mass |
| hydrophobized silica particles surface-treated with 10 percent by mass of hexamethyldisilazane | 2 parts by mass |

The above-described materials were mixed with Henschel Mixer (Model FM-75, produced by Mitsui Miike Chemical Engineering Machinery Co., Ltd.) and, thereafter, were kneaded with a twin screw kneader (Model PCM-30, produced by Ikegai Machinery Co.) set at a temperature of 120° C. The resulting kneaded material was cooled, and coarsely ground to 1 mm or less with a hammer mill, so that a coarsely ground material was obtained. The resulting coarsely ground material was pulverized with a mechanical pulverizer (T-250, produced by TURBO KOGYOU CO., LTD.), so that a pulverized material was obtained.

The resulting pulverized material was classified with a multi-division classifier utilizing Coanda effect, so that toner particles 1 were obtained.

Fine particle-added toner particles 1 were obtained by adding 3 parts by mass of hydrophobic silica fine particles surface-treated with 10 percent by mass of hexamethyldisilazane to 100 parts by mass of toner particles 1, followed by mixing with Henschel Mixer (Model FM-75, produced by Mitsui Miike Chemical Engineering Machinery Co., Ltd.).

The resulting fine particle-added toner particles 1 were subjected to a surface treatment with the heat treatment apparatus shown in FIG. 1, so that surface-treated toner particles 1 were obtained.

The inside diameter of the apparatus was specified to be 450 mm, the outside diameter of the cylindrical pole was specified to be 200 mm. Regarding the hot air supply device outlet portion, the inside diameter was specified to be 200 mm, and the outside diameter was specified to be 300 mm. Regarding the cold air supply device 1, the inside diameter was specified to be 350 mm, and the outside diameter was specified to be 450 mm.

The operating conditions were amount of feed (F)=15 kg/hr, hot air temperature (T1)=170° C., amount of hot air (Q1)=8.0 $m^3$/min, total amount of cold air 1 (Q2)=4.0 $m^3$/min, total amount of cold air 2 (Q3)=1.0 $m^3$/min, total amount of cold air 3 (Q4)=1.0 $m^3$/min, total amount of pole cold air (Q5)=0.5 $m^3$/min, amount of compressed gas (IJ)=1.6 $m^3$/min, and amount of air of blower (Q6)=23.0 $m^3$/min.

The resulting surface-treated toner particles 1 were classified again with the multi-division classifier utilizing Coanda effect, so that classified surface-treated toner particles 1 having desired particle diameters were obtained.

Toner 1 was obtained by adding 1.0 part by mass of titanium oxide fine particles surface-treated with 16 percent by mass of isobutyltrimethoxysilane and 0.8 parts by mass of hydrophobic silica fine particles surface-treated with 10 percent by mass of hexamethyldisilazane to 100 parts by mass of the resulting classified surface-treated toner particles 1, followed by mixing with Henschel Mixer (Model FM-75, produced by Mitsui Miike Chemical Engineering Machinery Co., Ltd.). The properties of the resulting Toner 1 are as shown in Table 1.

Toner Production Example 2

Toner 2 was obtained as in Toner production example 1 except that the amount of addition of the hydrophobized silica particles surface-treated with 10 percent by mass of hexamethyldisilazane was changed to 1.5 parts by mass. The properties of the resulting Toner 2 are as shown in Table 1.

Toner Production Example 3

Toner 3 was obtained as in Toner production example 1 except that the hot air temperature of the heat treatment condition was changed to 185° C. The properties of the resulting Toner 3 are as shown in Table 1.

Toner Production Example 4

Toner 4 was obtained as in Toner production example 1 except that the amount of addition of the hydrophobized silica particles surface-treated with 10 percent by mass of hexamethyldisilazane was changed to 1.0 part by mass. The properties of the resulting Toner 4 are as shown in Table 1.

Toner Production Example 5

Toner 5 was obtained as in Toner production example 4 except that the hot air temperature of the heat treatment condition was changed to 185° C. The properties of the resulting Toner 5 are as shown in Table 1.

Toner Production Example 6

Toner 6 was obtained as in Toner production example 4 except that the hot air temperature of the heat treatment condition was changed to 160° C. The properties of the resulting Toner 6 are as shown in Table 1.

Toner Production Example 7

| | |
|---|---|
| polyester resin A | 60 parts by mass |
| polyester resin B | 40 parts by mass |
| Fischer-Tropsch wax (peak temperature of maximum endothermic peak 78° C.) | 5 parts by mass |
| 3,5-di-t-butylsalicylic acid aluminum compound | 0.5 parts by mass |
| C.I. Pigment Blue 15:3 | 5 parts by mass |
| hydrophobized silica particles surface-treated with 10 percent by mass of hexamethyldisilazane | 0.5 parts by mass |

The above-described raw materials were used and toner particles 7 were obtained as in Toner production example 1.

Fine particle-added toner particles 7 were obtained by adding 2.0 parts by mass of hydrophobic silica fine particles surface-treated with 10 percent by mass of hexamethyldisilazane to 100 parts by mass of toner particles 7, followed by mixing with Henschel Mixer (Model FM-75, produced by Mitsui Miike Chemical Engineering Machinery Co., Ltd.).

The resulting fine particle-added toner particles 7 were subjected to a surface treatment with the heat treatment apparatus shown in FIG. 1, followed by classification and external addition, so that Toner 7 were obtained.

In this regard, the operating conditions in the heat treatment were amount of feed (F)=15 kg/hr, hot air temperature (T1)=170° C., amount of hot air (Q1)=7.0 $m^3$/min, total amount of cold air 1 (Q2)=4.0 $m^3$/min, total amount of cold air 2 (Q3)=1.0 $m^3$/min, total amount of cold air 3 (Q4)=1.0 $m^3$/min, total amount of pole cold air (Q5)=0.5 $m^3$/min, amount of compressed gas (IJ)=1.6 $m^3$/min, and amount of air of blower (Q6)=23.0 $m^3$/min.

The properties of the resulting Toner 7 are as shown in Table 1.

Toner Production Example 8

Toner 8 was obtained as in Toner production example 7 except that the hot air temperature of the heat treatment condition was changed to 190° C. The properties of the resulting Toner 8 are as shown in Table 1.

Toner Production Example 9

Toner 9 was obtained as in Toner production example 7 except that the hot air temperature of the heat treatment condition was changed to 195° C. The properties of the resulting Toner 9 are as shown in Table 1.

Toner Production Example 10

| | |
|---|---|
| polyester resin A | 60 parts by mass |
| polyester resin B | 40 parts by mass |
| Fischer-Tropsch wax (peak temperature of maximum endothermic peak 78° C.) | 5 parts by mass |
| 3,5-di-t-butylsalicylic acid aluminum compound | 0.5 parts by mass |
| C.I. Pigment Blue 15:3 | 5 parts by mass |

The above-described raw materials were used and toner particles 10 were obtained as in Toner production example 1.

Fine particle-added toner particles 10 were obtained by adding 1.0 part by mass of hydrophobic silica fine particles surface-treated with 10 percent by mass of hexamethyldisilazane to 100 parts by mass of toner particles 10, followed by mixing with Henschel Mixer (Model FM-75, produced by Mitsui Miike Chemical Engineering Machinery Co., Ltd.).

The resulting fine particle-added toner particles 10 were subjected to a surface treatment with the heat treatment apparatus shown in FIG. 1, followed by classification and external addition, so that Toner 10 were obtained.

In this regard, the operating conditions in the heat treatment were amount of feed (F)=15 kg/hr, hot air temperature (T1)=200° C., amount of hot air (Q1)=7.0 $m^3$/min, total amount of cold air 1 (Q2)=4.0 $m^3$/min, total amount of cold air 2 (Q3)=1.0 $m^3$/min, total amount of cold air 3 (Q4)=1.0 $m^3$/min, total amount of pole cold air (Q5)=0.5 $m^3$/min, amount of compressed gas (IJ)=1.6 $m^3$/min, and amount of air of blower (Q6)=23.0 $m^3$/min.

The properties of the resulting Toner 10 are as shown in Table 1.

Toner Production Example 11

In Toner production example 10, addition of hydrophobic silica fine particles surface-treated with 10 percent by mass of hexamethyldisilazane to 100 parts by mass of the resulting toner particles 10 was changed to 2.0 parts by mass and mixing with Henschel Mixer (Model FM-75, produced by Mitsui Miike Chemical Engineering Machinery Co., Ltd.) was performed, so that fine particle-added toner particles 11 were obtained. Furthermore, the hot air temperature of the heat treatment condition of the fine particle-added toner particles 11 was changed to 170° C. Toner 11 was obtained as in Toner production example 10 except those described above. The properties of the resulting Toner 11 are as shown in Table 1.

Toner Production Example 12

Toner 12 was obtained as in Toner production example 10 except that the hot air temperature of the heat treatment condition was changed to 185° C. The properties of the resulting Toner 12 are as shown in Table 1.

Toner Production Example 13

In Toner production example 10, fine particle-added toner particles 13 were obtained by adding 0.5 parts by mass of hydrophobic silica fine particles surface-treated with 10 percent by mass of hexamethyldisilazane to 100 parts by mass of the resulting toner particles 10, followed by mixing with Henschel Mixer (Model FM-75, produced by Mitsui Miike Chemical Engineering Machinery Co., Ltd.). Furthermore, the hot air temperature of the heat treatment condition of the resulting fine particle-added toner particles 13 was changed to 200° C. Toner 13 was obtained as in Toner production example 10 except those described above. The properties of the resulting Toner 13 are as shown in Table 1.

Toner Production Example 14

The toner particles 10 obtained in Toner production example 10 were heat-treated by using a surface modifying machine (Model MR-100: produced by Nippon Pneumatic Manufacturing Co., Ltd.).

In this regard, the operating conditions in the heat treatment were specified to be amount of feed (F)=15 kg/hr, hot air temperature=280° C., and amount of hot air=5.0 $m^3$/min.

The resulting surface-treated toner particles 14 were classified again with the multi-division classifier utilizing Coanda effect, so that classified surface-treated toner particles 14 having desired particle diameters were obtained.

Toner 14 was obtained by adding 1.0 part by mass of titanium oxide fine particles surface-treated with 16 percent by mass of isobutyltrimethoxysilane and 0.8 parts by mass of hydrophobic silica fine particles surface-treated with 10 percent by mass of hexamethyldisilazane to 100 parts by mass of the classified surface-treated toner particles 14, followed by mixing with Henschel Mixer (Model FM-75, produced by Mitsui Miike Chemical Engineering Machinery Co., Ltd.). The properties of the resulting Toner 14 are as shown in Table 1.

Toner Production Example 15

Toner 15 was obtained as in Toner production example 14 except that the hot air temperature of the heat treatment condition was changed to 245° C. The properties of the resulting Toner 15 are as shown in Table 1.

Toner Production Example 16

Toner 16 was obtained from the toner particles 10 obtained in Toner production example 10 under the same heat treatment condition as that in Toner production example 1. The properties of the resulting Toner 16 are as shown in Table 1.

Toner Production Example 17

Toner 17 was obtained as in Toner production example 16 except that the hot air temperature of the heat treatment condition was changed to 185° C. The properties of the resulting Toner 17 are as shown in Table 1.

Toner Production Example 18

Toner 18 was obtained as in Toner production example 13 except that the hot air temperature of the heat treatment condition was changed to 205° C. The properties of the resulting Toner 18 are as shown in Table 1.

Toner Production Example 19

Toner 19 was obtained as in Toner production example 13 except that the hot air temperature of the heat treatment condition was changed to 195° C. The properties of the resulting Toner 19 are as shown in Table 1.

Toner Production Example 20

Toner 20 was obtained as in Toner production example 1 except that the hot air temperature of the heat treatment condition was changed to 150° C. The properties of the resulting Toner 20 are as shown in Table 1.

Toner Production Example 21

Toner 21 was obtained as in Toner production example 10 except that the heat treatment step in Toner production example 10 was not performed. The properties of the resulting Toner 21 are as shown in Table 1.

Magnetic Carrier Production Example 1

(Weighing•Mixing Step)

Ferrite raw materials were weighed as described below.

| | |
|---|---|
| Fe2O3 | 59.8 percent by mass |
| MnCO3 | 34.7 percent by mass |
| Mg(OH)2 | 4.6 percent by mass |
| SrCO3 | 0.9 percent by mass |

Thereafter, grinding•mixing was performed for 2 hours with a dry ball mill by using zirconia balls (diameter 10 mm).

(Calcination Step)

After the grinding•mixing, firing was performed by using a burner type kiln in the air at 960° C. for 2 hours, so that calcined ferrite was produced.

(Grinding Step)

After grinding to about 0.5 mm with a crasher was performed, zirconia beads (diameter 1.0 mm) were used, 35 parts by mass of water was added to 100 parts by mass of the calcined ferrite, and grinding with wet beads mill was performed for 5 hours, so that a ferrite slurry was obtained.

(Granulation Step)

The ferrite slurry was blended with 1.5 parts by mass of polyvinyl alcohol serving as a binder relative to 100 parts by mass of calcined ferrite, and granulation to spherical particles was performed with Spray Dryer (Manufacturer: Ohkawara Kakohki Co., Ltd.).

(Full-scale Firing Step)

Firing was performed at 1,050° C. for 4 hours with an electric furnace in a nitrogen atmosphere (oxygen concentration 0.02 percent by volume) in order to control the firing atmosphere.

(Screening Step)

After aggregated particles were disintegrated, coarse particles were removed through screening by a sieve with a sieve opening of 250 μm, so that core particles 1 were obtained.

(Coating Step)

| | |
|---|---|
| Silicone varnish (SR2410 produced by Dow Corning Toray Silicone Co., Ltd., solid concentration 20 percent by mass) | 75.8 parts by mass |
| γ-aminopropyltriethoxysilane | 1.5 parts by mass |
| toluene | 22.7 parts by mass |

The above-described materials were mixed, so that a resin solution A was obtained.

After 100 parts by mass of core particles 1 were put into a universal mixer (produced by DALTON CORPORATION), heating to a temperature of 50° C. was performed under reduced pressure. The resin solution A corresponding to 15 parts by mass of resin component for filling relative to 100 parts by mass of core particles 1 was dropped over 2 hours and, furthermore, agitation was performed at a temperature of 50° C. for 1 hour. Subsequently, the temperature was raised to 80° C., so as to remove the solvent. The resulting sample was transferred to JULIA MIXER (TOKUJU CORPORATION), a heat treatment was performed in a nitrogen atmosphere at a temperature of 180° C. for 2 hours, and classification was performed through a mesh with a mesh opening of 70 μm, so that magnetic core particles 1 were obtained.

After 100 parts by mass of the resulting magnetic core 1 is put into Nauta Mixer (produced by Hosokawa Micron Corporation), adjustment to 70° C. was performed under reduced pressure while agitation was performed under the condition of a screw rotation speed of 100 $min^{-1}$ and a rotation speed of 3.5 $min^{-1}$. The resin solution A was diluted with toluene in such a way that the solid concentration became 10 percent by mass, and the resin solution was put in, so that a coating resin component became 0.5 parts by mass relative to 100 parts by mass of magnetic core 1. Removal of the solvent and application operation were performed over 2 hours. Thereafter, the temperature was raised to 180° C., and the agitation was continued 2 hours. Subsequently, the temperature was lowered to 70° C. The sample was transferred to a universal mixer (produced by DALTON CORPORATION). The resin solution A was used, and the resin solution was put in, so that a coating resin component became 0.5 parts by mass relative to 100 parts by mass of magnetic core 1 serving as a raw material. Removal of the solvent and application operation were performed over 2 hours. The resulting sample was transferred to JULIA MIXER (TOKUJU CORPORATION), a heat treatment was performed in a nitrogen atmosphere at a temperature of 180° C. for 4 hours, and classification was performed through a mesh with a mesh opening of 70 μm, so that a magnetic carrier 1 was obtained. The D50 of the resulting magnetic carrier 1 was 43.1 μm, the true specific gravity was 3.9 $g/cm^3$, and the amount of magnetization under 1,000 oersted was 52.7 Am2/kg.

Magnetic Carrier Production Example 2

A magnetic carrier 2 was obtained as in Magnetic carrier production example 1 except that in the full-scale firing step of Magnetic carrier production example 1, the oxygen concentration was changed to 0.3 percent by volume and the firing temperature was changed to 1,150° C. The D50 of the resulting magnetic carrier 2 was 45.0 μm, the true specific gravity was 4.8 g/cm$^3$, and the amount of magnetization under 1,000 oersted was 53.8 Am2/kg.

Magnetic Carrier Production Example 3

| | |
|---|---|
| Fe2O3 | 62.8 percent by mass |
| MnCO3 | 7.7 percent by mass |
| Mg(OH)2 | 15.6 percent by mass |
| SrCO3 | 13.9 percent by mass |

A magnetic carrier 3 was obtained as in Magnetic carrier production example 1 except that in the weighing•mixing step of Magnetic carrier production example 1, the raw material were changed to the above-described raw materials and in the full-scale firing step, the conditions were changed to in the air at a temperature of 1,300° C. for 4 hours. The D50 of the resulting magnetic carrier 3 was 40.4 μm, the true specific gravity was 3.6 g/cm$^3$, and the amount of magnetization under 1,000 oersted was 52.1 Am2/kg.

Electrophotographic Photosensitive Member Production Example 1

An electrophotographic photosensitive member 1 was produced as described below. Initially, an aluminum cylinder having a length of 370 mm, an outside diameter of 32 mm, and a thickness of 3 mm (an aluminum alloy specified in JIS A3003) was produced through cutting. The surface roughness of the resulting cylinder measured in the direction of the axis of rotation was Rzjis=0.08 μm. This cylinder was subjected to ultrasonic cleaning in pure water containing a detergent (trade name: Chemicohl CT, produced by TOKIWA CHEMICAL INDUSTRIES CO., LTD.), and subsequently was passed through a step of rinsing the detergent away. Then, ultrasonic cleaning was further performed in pure water to perform a degreasing treatment.

A slurry composed of 60 parts by mass of titanium oxide powder having a coating film of tin oxide doped with antimony (trade name: KRONOS ECT-62, produced by Titan Kogyou Ltd.), 60 parts by mass of titanium oxide powder (trade name: titone SR-1T, produced by Sakai Chemical Industry Co., Ltd.), 70 parts by mass of resol type phenol resin (trade name: PHENOLITE J-325, produced by DAINIPPON INK AND CHEMICALS, INCORPORATED, solid content 70%), 50 parts by mass of 2-methoxy-1-propanol, and 50 parts by mass of methanol was dispersed for about 20 hours with a ball mill, so as to obtain a dispersion. The average particle diameter of fillers contained in the resulting dispersion was 0.25 μm.

The thus prepared dispersion was applied to the above-described aluminum cylinder by a dipping method. The aluminum cylinder coated with the above-described dispersion was heated and dried for 48 minutes in a hot-air dryer adjusted at a temperature of 150° C. to cure the coating film of the above-described dispersion, so that an electrically conductive layer having a film thickness of 15 μm was formed.

Subsequently, a solution prepared by dissolving 10 parts by mass of copolymerization nylon resin (trade name: AMILAN CM8000, produced by Toray Industries, Ltd.) and 30 parts by mass of methoxymethylated nylon resin (trade name: TORESIN EF30T, produced by Teikoku Chemical Industries Co., Ltd.) into a mixed solution of 500 parts by mass of methanol and 250 parts by mass of butanol was applied to the above-described electrically conductive layer through dipping. The aluminum cylinder coated with the above-described solution was put in a hot-air dryer adjusted at a temperature of 100° C. for 22 minutes to cure the coating film of the above-described dispersion through heating and drying, so that an under coating layer having a film thickness of 0.45 μm was formed.

Then, a mixed solution composed of 4 parts by mass of hydroxygallium phthalocyanine pigment having strong peaks at Bragg angle 2θ±0.2° of 7.4° and 28.2° in a CuKa ray diffraction spectrum, 2 parts by mass of polyvinyl butyral resin (trade name: S-LEC BX-1, produced by Sekisui Chemical Co., Ltd.), and 90 parts by mass of cyclohexanone was dispersed for 10 hours with a sand mill by using glass beads having a diameter of 1 mm. Thereafter, 110 parts by mass of ethyl acetate was added to the resulting mixed solution, so that a coating solution for a charge generation layer was prepared. The resulting coating solution was applied to the above-described under coating layer through dipping. The aluminum cylinder coated with the above-described coating solution was put in a hot-air dryer adjusted at a temperature of 80° C. for 22 minutes to cure the coating film of the above-described coating solution through heating and drying, so that a charge generation layer having a film thickness of 0.17 μm was formed.

Next, 35 parts by mass of triarylamine based compound represented by Structural formula (II) described below Structural formula (11)

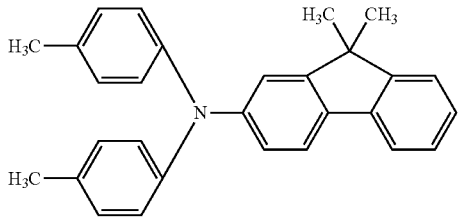

and 50 parts by mass of bisphenol Z type polycarbonate resin (trade name: Iupilon Z400, produced by Mitsubishi Engineering-Plastics Corporation) were dissolved into 320 parts by mass of monochlorobenzene and 50 parts by mass of dimethoxymethane, so as to prepare a coating solution for a charge transport layer. The resulting coating solution was applied to the above-described charge generation layer through dipping. The aluminum cylinder coated with the above-described coating solution was heated and dried in a hot-air dryer adjusted at a temperature of 100° C. for 40 minutes to cure the coating film of the above-described coating solution, so that a first charge transport layer having a film thickness of 20 μm was formed.

Subsequently, 30 parts by mass of hole transport compound having a polymerizable functional group represented by Structural formula (12) described below Structural formula (12)

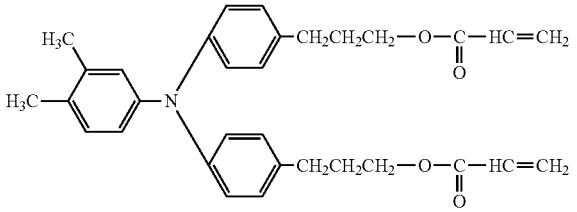

was dissolved into 35 parts by mass of 1-propanol and 35 parts by mass of 1,1,2,2,3,3,4-heptafluorocyclopentane (trade name: ZEORORA H, produced by ZEON Corporation). Thereafter, pressure filtration was performed with a 0.5 μm PTFE membrane filter, so that a coating solution for a second charge transport layer serving as a curable surface layer was prepared. The resulting coating solution was applied to the above-described first charge transport layer by a dip-coating method, so that a coating film for a second charge transport layer serving as a curable surface layer was formed. Thereafter, the above-described coating film was irradiated with electron beams in nitrogen under conditions of an accelerating voltage of 150 kV and a dose of 15 kGy, so that an aluminum cylinder (electrophotographic photosensitive member) with a cured coating film was obtained. Subsequently, a heating treatment was performed for 90 seconds under the condition in which the temperature of the electrophotographic photosensitive member became 120° C. The oxygen concentration at this time was 10 ppm. Furthermore, the electrophotographic photosensitive member was heated and dried in the air for 20 minutes in a hot-air dryer adjusted at a temperature of 100° C., so that a curable surface layer having a film thickness of 5 μm was formed. The elastic deformation rate of the resulting image bearing member was 55%.

Electrophotographic Photosensitive Member Production Example 2

An image bearing member was obtained as in Electrophotographic photosensitive member production example 1, wherein the electron beam irradiation condition in Electrophotographic photosensitive member production example 1 was changed to an accelerating voltage of 100 kV and a dose of 10 kGy in nitrogen. The elastic deformation rate of the resulting image bearing member was 45%.

Electrophotographic Photosensitive Member Production Example 3

An image bearing member was obtained as in Electrophotographic photosensitive member production example 1, wherein the electron beam irradiation condition in Electrophotographic photosensitive member production example 1 was changed to an accelerating voltage of 200 kV and a dose of 20 kGy in nitrogen. The elastic deformation rate of the resulting image bearing member was 65%.

Examples 1 to 13

Comparative examples 1 to 8

A binary developer was formed by combining the toner and the magnetic carrier as shown in Table 2. At that time, the binary developer was formed by adding 10.0 parts by mass of toner relative to 90.0 parts by mass of magnetic carrier and performing mixing with a V type mixer.

The developer formed as described above was packed into a developing apparatus and a refill described below, and temperature control and humidity control were performed in an ambient temperature and low humidity environment (temperature 23° C., humidity 4% RH) or a high temperature and high humidity environment (temperature 32.5° C., humidity 80% RH).

As for an evaluation machine, a digital full-color copier Image Press C1 produced by CANON KABUSHIKI KAISHA and modified as described below was used.

An electrophotographic photosensitive member attached to the developing apparatus of the above-described machine was taken out and was replaced with any one of the formed electrophotographic photosensitive members 1 to 3. An alternating current voltage with a frequency of 1.5 kHz and a voltage between peaks (Vpp 1.0 kV) and a direct current voltage $V_{DC}$ were applied to the development sleeve. Furthermore, the cleaning apparatus was modified, and the average contact surface pressure of a contact nip portion of the image bearing member and the cleaning blade was changed as shown in Table 2. In addition, the fixing temperature was able to be set freely. In this regard, the cleaning blade attached to the product was used as-is.

The above-described developer and the evaluation machine were used, and the evaluation was performed as described below. In this regard, as for the transfer-receiving member, laser beam printer sheet CS-814 (A4, 81.4 g/m$^2$) was used. The toners, magnetic carriers, image bearing members, and average contact surface pressures of a contact nip portion of the image bearing member and the cleaning blade employed in the individual Examples and Comparative examples are as shown in Table 2.

(Evaluation Details in an Ambient Temperature and Low Humidity Environment (Temperature 23° C., Humidity 5% RH))

"Image Stability"

The developing apparatus and the refill were set in the above-described apparatus. Thereafter, the developing bias was adjusted in such a way that the amount of development of the toner on the photosensitive member became 0.42 g/cm$^2$, and a solid image was output for initial evaluation.

Then, 15,000 sheets (15 k) of image with a coverage of 40% was output while a constant amount of toner was supplied in such a way that the density was kept constant. After 15 k endurance was completed, a solid image was further output and the density of the solid image was measured. Thereafter, 15,000 sheets (15 k) of image with a coverage of 1% was further output while a constant amount of toner was supplied in such a way that the density was kept constant, so that 30 k endurance was performed. After the 30 k endurance, a solid image was output again and the density of the solid image was measured.

Regarding the image density, the density was measured with a densitometer Model X-Rite 500, and average value of 5 points was assumed to be the image density. The rates of change in image density D1-D15 and D1-D30 were determined, where the initial image density was assumed to be D1, the image density after 15 k endurance was assumed to be D15, and the image density after 30 k endurance was assumed to be D30.

Evaluation Results of D1-D15

A: Rate of change in image density D1-D15 was less than 0.05.

B: Rate of change in image density D1-D15 was 0.05 or more, and less than 0.10.

C: Rate of change in image density D1-D15 was 0.10 or more, and less than 0.20.

D: Rate of change in image density D1-D15 was 0.20 or more.

Evaluation Results of D1-D30

A: Rate of change in image density D1-D30 was less than 0.10.

B: Rate of change in image density D1-D30 was 0.10 or more, and less than 0.15.

C: Rate of change in image density D1-D30 was 0.15 or more, and less than 0.25.

D: Rate of change in image density D1-D30 was 0.25 or more.

(Evaluation Details in a High Temperature and High Humidity Environment (Temperature 32.5° C., Humidity 80% RH))

The developing bias was set in such a way that the amount of toner laid on the photosensitive member became 0.42 g/cm$^2$ in an environment of a temperature of 32.5° C. and a humidity of 80% RH. As for an initial evaluation, the evaluation of fogging of a non-image area, the evaluation of cleanability, and the evaluation of transfer residue were performed, as described below.

Then, 15,000 sheets (15 k) of image with a coverage of 40% was output while a constant amount of toner was supplied in such a way that the density was kept constant. After 15 k endurance, the evaluation of fogging of a non-image area and the evaluation of transfer residue were performed.

Thereafter, 15,000 sheets (15 k) of image with a coverage of 1% was further output while a constant amount of toner was supplied in such a way that the density was kept constant, so that 30 k endurance was performed. After the 30 k endurance was completed, the evaluation of fogging of the non-image area and the evaluation of transfer residue were performed.

[Evaluation of Fogging of Non-image Area]

Blank images were output at an initial stage, after 15 k endurance, and 30 k endurance. The fog density of an output sheet central portion at the position 50 mm from the end of the transfer-receiving member was measured. The fog density of the transfer-receiving member before the output was subtracted from the resulting density to determine the difference in density. The difference in fog density at the initial stage, the difference in fog density after 15 k endurance, and the difference in fog density after 30 k endurance were evaluated on the basis of the evaluation criteria described below. In this regard, the fog density was measured with DENSITOMETER TC-6DS (produced by Tokyo Denshoku Co., Ltd.).

(Evaluation Criteria of at Initial Stage)

A: less than 0.5

B: 0.5 or more, and less than 1.0

C: 1.0 or more, and less than 2.0

D: 2.0 or more (Evaluation Criteria of after 15 k Endurance)

A: less than 1.0

B: 1.0 or more, and less than 1.5

C: 1.5 or more, and less than 2.5

D: 2.5 or more (Evaluation Criteria of after 30 k Endurance)

A: less than 1.0

B: 1.0 or more, and less than 1.5

C: 1.5 or more, and less than 2.5

D: 2.5 or more

[Transfer Efficiency (Transfer Residual Density)]

Solid images were output at an initial stage, after 15 k endurance, and after 30 k endurance. At that time, development was terminated in midstream, a transfer residual toner on a photosensitive drum in the image formation was peeled off by taping with a transparent polyester adhesive tape. The difference in density in each case was calculated by subtracting the density of the paper with only an adhesive tape stuck thereon from the density of the paper with the peeled adhesive tape stuck thereon. Evaluation was performed on the basis of the evaluation criteria described below. In this regard, the transfer residual density was measured with X-Rite color reflection densitometer (500 series).

(Evaluation Criteria of at Initial Stage)

A: less than 0.10

B: 0.10 or more, and less than 0.15

C: 0.15 or more, and less than 0.25

D: 0.25 or more (Evaluation Criteria of after 15 k Endurance)

A: less than 0.15

B: 0.15 or more, and less than 0.20

C: 0.20 or more, and less than 0.30

D: 0.30 or more (Evaluation Criteria of after 30 k Endurance)

A: less than 0.15

B: 0.15 or more, and less than 0.20

C: 0.20 or more, and less than 0.30

D: 0.30 or more

[Evaluation of Cleanability]

Half tone images were printed at an initial stage and after 30 k endurance, and evaluation was performed by visual observation.

(Evaluation Criteria)

A: Stain did not occur.

B: Minute stain occurred, but there was no problem practically.

C: Spot-like or linear stains occurred in places.

D: Spot-like or linear stains occurred conspicuously.

Examples 14 and 15

The image stability, the fogging of non-image area, and the transfer residual density were evaluated as in Example 2 except that the magnetic carrier was changed as shown in Table 2. The evaluation results are shown in Table 4.

The true specific gravity of the magnetic carrier was changed and, thereby, toner-spent to the magnetic carrier was suppressed and the fogging of the non-image area associated with a reduction in the amount of charge of toner was improved. It is believed that the toner according to the present invention had excellent stress resistance and, therefore, degradation of fogging of the non-image area was suppressed even in the case where the true specific gravity was changed on a purpose basis.

Examples 16 to 23

The cleanability before and after the endurance was evaluated as in Example 2 except that the image bearing member and the average contact surface pressure of a contact nip portion of the image bearing member and the cleaning blade was changed as shown in Table 2. The evaluation results are shown in Table 5.

The cleanability at the initial stage is improved by increasing the average contact surface pressure of a contact nip portion of the image bearing member and the cleaning blade, although after the endurance, it is observed that there is a tendency of the cleanability of the image bearing member having a large elastic deformation rate to be degraded because of vibration of the blade. However, degradation of the cleanability after the endurance because of vibration of the cleaning blade was suppressed by using the toner according to the present invention. Consequently, it is believed that the image forming method can extend the life.

TABLE 1

| Toner | Multisizer Coulter Counter III | | | FPIA-3000 | | |
|---|---|---|---|---|---|---|
| | Weight average particle diameter (D4) | Proportion of particles of 4 μm or less (percent by the number) | Proportion of particles of 10 μm or more (percent by the number) | Average circularity | Proportion of particles having circularity of 0.990 or more (percent by the number) | Proportion of particles having circle equivalent diameter of 2 μm or less (percent by the number) |
| Toner 1 | 6.1 | 23.9 | 0.7 | 0.967 | 10.2 | 3.4 |
| Toner 2 | 6.1 | 24.5 | 0.6 | 0.965 | 10.1 | 6.5 |
| Toner 3 | 6.1 | 24.6 | 0.6 | 0.972 | 12.4 | 1.1 |
| Toner 4 | 6.1 | 24.8 | 0.7 | 0.967 | 15.7 | 5.3 |
| Toner 5 | 6.0 | 25.1 | 0.4 | 0.972 | 18.0 | 2.6 |
| Toner 6 | 6.1 | 24.9 | 0.5 | 0.962 | 10.8 | 8.9 |
| Toner 7 | 6.0 | 25.6 | 0.4 | 0.965 | 12.7 | 9.1 |
| Toner 8 | 6.1 | 25.1 | 0.5 | 0.976 | 18.4 | 6.0 |
| Toner 9 | 6.0 | 25.4 | 0.4 | 0.981 | 22.0 | 3.3 |
| Toner 10 | 6.1 | 25.1 | 0.8 | 0.984 | 24.3 | 6.4 |
| Toner 11 | 6.1 | 24.1 | 0.3 | 0.965 | 16.2 | 9.0 |
| Toner 12 | 6.0 | 23.9 | 0.2 | 0.975 | 20.3 | 8.9 |
| Toner 13 | 6.0 | 23.7 | 0.8 | 0.984 | 24.1 | 8.8 |
| Toner 14 | 6.0 | 25.8 | 0.6 | 0.961 | 26.4 | 24.1 |
| Toner 15 | 6.2 | 23.9 | 0.6 | 0.958 | 23.0 | 25.4 |
| Toner 16 | 6.1 | 25.4 | 0.7 | 0.967 | 22.3 | 14.5 |
| Toner 17 | 6.1 | 25.6 | 0.7 | 0.972 | 26.1 | 13.1 |
| Toner 18 | 6.0 | 24.8 | 0.6 | 0.986 | 26.2 | 8.3 |
| Toner 19 | 5.9 | 24.1 | 0.6 | 0.981 | 22.2 | 11.1 |
| Toner 20 | 5.9 | 23.8 | 0.5 | 0.958 | 4.4 | 12.0 |
| Toner 21 | 6.0 | 24.9 | 0.2 | 0.945 | 2.0 | 32.6 |

TABLE 2

| Example | Toner | Magnetic carrier | Image bearing member | Elastic deformation rate (%) | Blade contact surface pressure (gf/cm2) |
|---|---|---|---|---|---|
| Example 1 | Toner 1 | magnetic carrier 2 | image bearing member 2 | 55 | 20 |
| Example 2 | Toner 2 | magnetic carrier 2 | image bearing member 2 | 55 | 20 |
| Example 3 | Toner 3 | magnetic carrier 2 | image bearing member 2 | 55 | 20 |
| Example 4 | Toner 4 | magnetic carrier 2 | image bearing member 2 | 55 | 20 |
| Example 5 | Toner 5 | magnetic carrier 2 | image bearing member 2 | 55 | 20 |
| Example 6 | Toner 6 | magnetic carrier 2 | image bearing member 2 | 55 | 20 |
| Example 7 | Toner 7 | magnetic carrier 2 | image bearing member 2 | 55 | 20 |
| Example 8 | Toner 8 | magnetic carrier 2 | image bearing member 2 | 55 | 20 |
| Example 9 | Toner 9 | magnetic carrier 2 | image bearing member 2 | 55 | 20 |
| Example 10 | Toner 10 | magnetic carrier 2 | image bearing member 2 | 55 | 20 |
| Example 11 | Toner 11 | magnetic carrier 2 | image bearing member 2 | 55 | 20 |
| Example 12 | Toner 12 | magnetic carrier 2 | image bearing member 2 | 55 | 20 |
| Example 13 | Toner 13 | magnetic carrier 2 | image bearing member 2 | 55 | 20 |
| Comparative example 1 | Toner 14 | magnetic carrier 2 | image bearing member 2 | 55 | 20 |
| Comparative example 2 | Toner 15 | magnetic carrier 2 | image bearing member 2 | 55 | 20 |
| Comparative example 3 | Toner 16 | magnetic carrier 2 | image bearing member 2 | 55 | 20 |
| Comparative example 4 | Toner 17 | magnetic carrier 2 | image bearing member 2 | 55 | 20 |
| Comparative example 5 | Toner 18 | magnetic carrier 2 | image bearing member 2 | 55 | 20 |
| Comparative example 6 | Toner 19 | magnetic carrier 2 | image bearing member 2 | 55 | 20 |
| Comparative example 7 | Toner 20 | magnetic carrier 2 | image bearing member 2 | 55 | 20 |
| Comparative example 8 | Toner 21 | magnetic carrier 2 | image bearing member 2 | 55 | 20 |
| Example 14 | Toner 2 | magnetic carrier 3 | image bearing member 2 | 55 | 20 |
| Example 15 | Toner 2 | magnetic carrier 1 | image bearing member 2 | 55 | 20 |
| Example 16 | Toner 2 | magnetic carrier 2 | image bearing member 2 | 55 | 10 |
| Example 17 | Toner 2 | magnetic carrier 2 | image bearing member 2 | 55 | 30 |
| Example 18 | Toner 2 | magnetic carrier 2 | image bearing member 1 | 40 | 10 |
| Example 19 | Toner 2 | magnetic carrier 2 | image bearing member 1 | 40 | 20 |
| Example 20 | Toner 2 | magnetic carrier 2 | image bearing member 1 | 40 | 30 |
| Example 21 | Toner 2 | magnetic carrier 2 | image bearing member 3 | 70 | 10 |
| Example 22 | Toner 2 | magnetic carrier 2 | image bearing member 3 | 70 | 20 |
| Example 23 | Toner 2 | magnetic carrier 2 | image bearing member 3 | 70 | 30 |

TABLE 3

| | Image stability | | Fogging | | | Transfer residue | | | Cleanability | |
|---|---|---|---|---|---|---|---|---|---|---|
| Example | D1-D15 | D1-D30 | Initial | After 15k | After 30k | Initial | After 15k | After 30k | Initial | After 30k |
| Example 1 | A(0.02) | A(0.04) | A(0.2) | A(0.7) | A(0.8) | A(0.07) | A(0.11) | B(0.18) | A | A |
| Example 2 | A(0.04) | A(0.07) | A(0.3) | A(0.7) | A(0.9) | A(0.07) | A(0.14) | C(0.21) | A | A |
| Example 3 | A(0.02) | A(0.05) | A(0.3) | A(0.7) | A(0.9) | A(0.06) | A(0.13) | B(0.19) | B | B |
| Example 4 | A(0.04) | A(0.07) | A(0.3) | A(0.8) | B(1.0) | A(0.07) | B(0.15) | C(0.22) | A | A |
| Example 5 | A(0.02) | A(0.05) | A(0.4) | A(0.7) | A(0.9) | A(0.06) | A(0.12) | B(0.19) | B | B |
| Example 6 | B(0.09) | B(0.12) | A(0.3) | B(1.0) | B(1.2) | A(0.08) | B(0.17) | C(0.24) | A | A |
| Example 7 | B(0.09) | B(0.14) | A(0.3) | B(1.1) | C(1.6) | A(0.08) | B(0.15) | C(0.22) | A | A |
| Example 8 | A(0.04) | B(0.10) | A(0.4) | A(0.8) | B(1.2) | A(0.05) | A(0.10) | B(0.15) | B | B |
| Example 9 | A(0.03) | A(0.08) | A(0.3) | A(0.7) | B(1.1) | A(0.04) | A(0.08) | A(0.12) | C | C |
| Example 10 | A(0.04) | B(0.10) | A(0.3) | A(0.9) | C(1.5) | A(0.04) | A(0.07) | A(0.11) | C | C |
| Example 11 | B(0.08) | B(0.12) | A(0.3) | B(1.1) | C(1.6) | A(0.07) | A(0.13) | C(0.20) | A | A |
| Example 12 | B(0.09) | C(0.15) | A(0.3) | B(1.2) | C(1.8) | A(0.05) | A(0.09) | B(0.15) | B | B |
| Example 13 | B(0.09) | C(0.17) | A(0.3) | B(1.4) | C(2.1) | A(0.03) | A(0.06) | A(0.10) | C | C |
| Comparative example 1 | C(0.14) | D(0.29) | A(0.3) | C(1.7) | D(2.5) | A(0.09) | B(0.15) | C(0.22) | A | B |
| Comparative example 2 | C(0.14) | D(0.29) | A(0.3) | C(1.7) | D(2.5) | B(0.13) | C(0.20) | D(0.30) | A | A |
| Comparative example 3 | C(0.12) | D(0.26) | A(0.4) | C(1.5) | C(2.2) | A(0.07) | A(0.13) | C(0.22) | A | A |
| Comparative example 4 | C(0.12) | D(0.25) | A(0.3) | C(1.5) | C(2.2) | A(0.06) | A(0.10) | B(0.18) | B | C |
| Comparative example 5 | B(0.05) | C(0.15) | A(0.4) | A(0.9) | C(1.8) | A(0.03) | A(0.06) | A(0.07) | C | D |
| Comparative example 6 | C(0.12) | D(0.25) | A(0.2) | B(1.1) | C(1.9) | A(0.04) | A(0.06) | A(0.08) | C | C |
| Comparative example 7 | C(0.12) | D(0.25) | A(0.2) | B(1.1) | C(1.5) | B(0.13) | C(0.24) | D(0.32) | A | A |
| Comparative example 8 | C(0.15) | D(0.25) | A(0.3) | C(1.9) | D(2.8) | C(0.15) | C(0.25) | D(0.33) | A | A |

TABLE 4

| | Image stability | | Fogging | | | Transfer residue | | |
|---|---|---|---|---|---|---|---|---|
| Example | D1-D15 | D1-D30 | Initial | After 15k | After 30k | Initial | After 15k | After 30k |
| Example 2 | A(0.04) | A(0.07) | A(0.3) | A(0.7) | A(0.9) | A(0.07) | A(0.14) | C(0.21) |
| Example 14 | A(0.05) | B(0.10) | A(0.3) | B(1.3) | B(1.4) | A(0.07) | B(0.16) | D(0.23) |
| Example 15 | A(0.03) | A(0.06) | A(0.3) | A(0.7) | A(0.8) | A(0.07) | A(0.10) | B(0.18) |

TABLE 5

| | Cleanability | |
|---|---|---|
| Example | Initial | After 30 k |
| Example 2 | A | A |
| Example 16 | A | A |
| Example 17 | A | B |
| Example 18 | A | A |
| Example 19 | A | A |
| Example 20 | A | A |
| Example 21 | A | A |
| Example 22 | A | B |
| Example 23 | A | C |

According to the present invention, a toner exhibiting excellent stress resistance and having the transfer efficiency and the cleanability in combination can be provided.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of International Application No. PCT/JP2009/070855, filed Dec. 14, 2009, which is hereby incorporated by reference herein in its entirety.

Reference Signs List

| | |
|---|---|
| 1 | heat treatment apparatus main body |
| 2 | hot air supply device |
| 3 | cold air supply device 1 |
| 4 | cold air supply device 2 |
| 5 | cold air supply device 3 |
| 8 | raw material supply device |
| 13 | recovery device |
| 14 | pole |

The invention claimed is:

1. A toner characterized by comprising toner particles containing at least a binder resin and a wax, wherein the toner has a weight average particle diameter (D4) of 3.0 μm or more, and 8.0 μm or less and satisfies the following conditions (a) and (b) in the measurement with a flow particle image analyzer with an image processing resolution of 512×512 pixels, (a) regarding particles having a circle equivalent diameter of 1.98 μm or more, and 200.00 μm or less, the average circularity of the toner is 0.960 or more, and 0.985 or less and particles having a circularity of 0.990 or more, and 1.000 or less constitute 25.0 percent by the number or less, (b) particles having a circle equivalent diameter of 0.50 μm or more, and 1.98 μm or less constitute 10.0 percent by the number or less of particles having a circle equivalent diameter of 0.50 μm or more, and 200.00 μm or less.

2. The toner according to claim 1, characterized in that the toner particles have been subjected to a surface treatment with a hot air.

3. The toner according to claim 1, characterized in that the toner particles have been produced by subjecting toner particles containing inorganic fine particles to a surface treatment with a hot air.

4. A binary developer comprising a toner and a magnetic carrier, characterized in that the toner is the toner according to claim 1.

5. An image forming method characterized by comprising the steps of charging an image bearing member; forming an electrostatic latent image on the image bearing member charged in the charging; developing the electrostatic latent image formed on the image bearing member by using a binary developer including a toner to form a toner image; transferring the toner image on the image bearing member to a transfer-receiving member through or not through an intermediate transfer member; cleaning a transfer residual toner on the surface of the image bearing member; and fixing the toner image to the transfer-receiving member with heat and/or pressure, wherein the binary developer is the binary developer according to claim 4.

6. The image forming method according to claim 5, characterized in that blade-cleaning to perform cleaning by bringing a blade into contact with the surface of the image bearing member is included and the elastic deformation rate of an outermost surface layer on the image bearing member is 40% or more, and 70% or less.

7. The image forming method according to claim 6, characterized in that the outermost surface layer on the image bearing member comprises a material produced by curing a compound having a polymerizable functional group through polymerization or cross-linking.

* * * * *